US007357482B2

(12) United States Patent
Sugahara

(10) Patent No.: US 7,357,482 B2
(45) Date of Patent: Apr. 15, 2008

(54) LIQUID DROPLET-EJECTING APPARATUS, INK-JET PRINTER, AND LIQUID DROPLET-MOVING APPARATUS

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 277 days.

(21) Appl. No.: 11/090,837

(22) Filed: Mar. 25, 2005

(65) Prior Publication Data

US 2005/0219313 A1 Oct. 6, 2005

(30) Foreign Application Priority Data

Mar. 31, 2004 (JP) ..... 2004-108122

(51) Int. Cl.
*B41J 2/15* (2006.01)

(52) U.S. Cl. ..... 347/40; 347/43; 347/47; 347/29

(58) Field of Classification Search ..... 347/40, 347/43, 47, 71, 29
See application file for complete search history.

(56) References Cited

U.S. PATENT DOCUMENTS 4,454,519 A * 6/1984 Oosaka et al. ..... 347/45
5,798,778 A * 8/1998 Kimura et al. ..... 347/45
5,949,454 A * 9/1999 Nozawa et al. ..... 347/45
6,474,566 B1 * 11/2002 Hirota et al. ..... 239/102.2
6,511,156 B1 * 1/2003 Kazama et al. ..... 347/47
6,752,326 B2 6/2004 Hirota et al.
2005/0012778 A1 * 1/2005 Nishino et al. ..... 347/29

FOREIGN PATENT DOCUMENTS

JP A 2-88247 3/1990
JP A 6-210859 8/1994
JP A 11-268284 10/1999
JP A 2002-86021 3/2002

* cited by examiner

*Primary Examiner*—Matthew Luu
*Assistant Examiner*—Joshua M Dubnow
(74) *Attorney, Agent, or Firm*—Oliff & Berridge, PLC

(57) ABSTRACT

A liquid droplet-ejecting apparatus includes a liquid flow passage and a liquid discharge surface which is formed with a plurality of nozzles communicated with the liquid flow passage, a liquid-repellent area, and two hydrophilic areas for interposing the liquid-repellent area therebetween respectively and which has one of the hydrophilic areas positioned nearer to the nozzles than the other of the hydrophilic areas. A boundary of the liquid-repellent area with respect to one of the hydrophilic areas has liquid repellence lower than that of a boundary of the liquid-repellent area with respect to the other of the hydrophilic areas. The liquid droplet can be moved in a direction to make separation from the nozzles in accordance with the movement of the liquid droplet-ejecting apparatus. Therefore, it is possible to decrease the number of times of the wiping operation on the liquid discharge surface.

31 Claims, 18 Drawing Sheets

LIQUID DROPLET-EJECTING APPARATUS, INK-JET PRINTER, AND LIQUID DROPLET-MOVING APPARATUS

BACKGROUND OF THE INVENTION

1. Field of the Invention

The present invention relates to a liquid droplet-ejecting apparatus, an ink-jet printer including an ink jet head for discharging an ink onto a recording medium, and a liquid droplet-moving apparatus.

2. Description of the Related Art

Japanese Patent Application Laid-open No. 2002-86021 corresponding to U.S. Pat. Nos. 6,474,566 and 6,752,326 describes a liquid discharge apparatus in which liquid-repelling processing grooves with deteriorated liquid repellence are formed on a liquid-repelling processing layer formed around discharge holes of nozzles for discharging a liquid. In the case of the liquid discharge apparatus, the liquid-repelling processing grooves are incised around the discharge holes of the nozzles. Accordingly, when the liquid droplets, which are retained on the liquid-repelling processing layer around the discharge holes of the nozzles without being scattered although they are discharged from the nozzles, are gradually increased or grown as the liquid droplets are repeatedly discharged from the nozzles, the grown liquid droplets are attracted and introduced into the liquid-repelling processing grooves. Thus, it is possible to remove the grown liquid droplets from the surroundings of the discharge holes of the nozzles. Therefore, it is possible to avoid the discharge failure which would be otherwise caused by the liquid droplets remaining in the discharge holes of the nozzles.

However, in the case of the liquid discharge apparatus described in Japanese Patent Application Laid-open No. 2002-86021, the liquid droplets, which have been attracted and introduced into the liquid-repelling processing grooves, stay in the liquid-repelling processing grooves. The staying liquid droplets will overflow thereafter. Therefore, it is consequently necessary to remove the liquid droplets retained around the discharge ports of the nozzles by performing the wiping operation with a blade or the like. If the wiping operation is performed excessively frequently, a problem arises such that the liquid-repelling processing layer is gradually deteriorated due to the abrasion.

SUMMARY OF THE INVENTION

In view of the above, an object of the present invention is to provide a liquid droplet-ejecting apparatus, and an ink-jet printer including an ink-jet head which make it possible to lower the execution frequency of the wiping operation.

According to a first aspect of the present invention, there is provided a liquid droplet-ejecting apparatus comprising:

- a liquid droplet discharge surface;
- a nozzle array which is formed on the liquid droplet discharge surface and which includes a plurality of nozzles for discharging a liquid;
- a plurality of first areas which are formed on the liquid droplet discharge surface; and
- a second area which is formed on the liquid droplet discharge surface, which is positioned adjacently to the first areas between adjoining two first areas, and which has liquid repellence higher than that of the two first areas, wherein:
- a liquid droplet, which exists in one of the two first areas adjacent to the second area on a side near to the nozzle array, requires a first force to enter the second area, and
- a liquid droplet, which exists in the other of the two first areas adjacent to the second area on a side far from the nozzle array, requires a second force to enter the second area, the first force being smaller than the second force.

According to a second aspect of the present invention, there is provided a liquid droplet-ejecting apparatus comprising:

- a liquid flow passage which is formed in the liquid droplet-ejecting apparatus; and
- a liquid droplet discharge surface on which a plurality of nozzles communicated with the liquid droplet flow passage, a liquid-repellent area, and two hydrophilic areas which interpose the liquid-repellent area therebetween are formed respectively, wherein one of the hydrophilic areas is positioned nearer to the nozzles than the other of the hydrophilic areas, wherein:
- a boundary of the liquid-repellent area with respect to one of the hydrophilic areas has liquid repellence lower than that of a boundary of the liquid-repellent area with respect to the other of the hydrophilic areas.

According to a third aspect of the present invention, there is provided an ink-jet printer-comprising an ink-jet head which has a nozzle array including a plurality of nozzles for discharging an ink, the nozzle array being formed on an ink discharge surface; a medium transport unit which transports a medium on which the ink discharged from the plurality of nozzles lands; and a reciprocating movement unit which reciprocates the ink-jet head in a direction perpendicular to an extending direction of the nozzle array. In this printer, the ink discharge surface of the ink-jet head is formed with two first areas which extend in the extending direction of the nozzle array, and a second area which has liquid repellence higher than that of the first areas and which extends in the extending direction of the nozzle array while being adjacent to the two first areas between the two first areas; and an ink droplet, which exists in one of the two first areas adjacent to the second area in a direction to make approach to the nozzle array, requires a first force to enter the second area, and an ink droplet, which exists in the other of the two first areas adjacent to the second area in a direction to make separation from the nozzle array, requires a second force to enter the second area, the first force being smaller than the second force.

Accordingly, the ink droplets, which are adhered to the ink discharge surface, for example, by the inertial force and/or the force received by the air, can be distanced from the nozzles. As a result, it is possible to decrease the frequency of execution of the wiping operation for the ink discharge surface. Therefore, the ink discharge surface is successfully allowed to have a long service life. Further, when the present invention is used for a serial printer, it is possible to obtain a high printing speed.

The reciprocating movement unit may move the ink-jet head at a velocity to apply, to the ink droplets, a wind force which is larger than the first force and which is smaller than the second force. Accordingly, a predetermined wind force can be applied to the ink droplets by utilizing the reciprocating movement unit. Further, it is unnecessary to add any special structure in order to apply the wind force to the ink droplets. Therefore, the production cost of the ink-jet printer is not increased.

In the present invention, the first areas and the second area may extend in an extending direction of the nozzle array. Accordingly, it is easy to form the first areas and the second area. Further, it is easy to distance the liquid droplets far from the nozzle array.

In the present invention, the plurality of the first areas and at least one or more of the second area or areas may be formed on both sides of the nozzle array, respectively. This arrangement is effective for a serial printer in which the direction of the force received by the air is alternately changed.

In the present invention, a plurality of the second areas may be provided; and the plurality of first areas and the plurality of second areas may be alternately formed while adjoining to one another. Accordingly, it is possible to distance the liquid droplets far from the nozzles.

In the present invention, the nozzles of the nozzle array may be formed in a third area which has a same liquid repellence as that of the second area, and the third area may be positioned adjacently to the first areas between the adjoining two first areas. Accordingly, the liquid droplets scarcely remain around the nozzles.

In the present invention, the first and second areas may extend to surround the nozzle. Accordingly, the liquid droplets can be also distanced in directions which intersect the extending direction of the nozzle array.

In this arrangement, a boundary line, which is disposed between a first area and the third area adjacent to the first area on a side near to the nozzle array, may be a straight line which is parallel to an extending direction of the nozzle array; and a boundary line, which is disposed between the first area and the second area adjacent to the first area on a side far from the nozzle array, may be a line which includes portions having different angles of inclination, or a line which includes two types of line segments continued alternately and inclined symmetrically with respect to the extending direction of the nozzle array. Accordingly, when the liquid droplet is moved in the direction to make separation from the nozzles, the rising angle of the liquid droplet easily arrives at the critical angle to enter the second area from the first area. Therefore, it is easy to move the liquid droplet in the direction to make separation from the nozzles. Further, when the liquid droplet is moved in the direction to make approach to the nozzles, the liquid droplet hardly enters the second area.

In the present invention, a plurality of zones, which have liquid repellence higher than that of the first areas, may be provided in the second area so that the liquid repellence is increased in a stepwise manner as a zone position is farther from the nozzle array in a direction perpendicular to an extending direction of the nozzle array. In the present invention, a large number of portions, which have liquid repellence lower or higher than that of the second area, may be formed in the second area, and the portions, which have the lower or higher liquid repellence in the second area, may have an average density which is gradually decreased or increased in a direction which makes separation from the nozzle array and which is perpendicular to an extending direction of the nozzle array. Accordingly, when the liquid droplet is moved in the direction to make separation from the nozzles, the liquid droplet easily enters the second area from the first area. Further, when the liquid droplet is moved in the direction to make approach to the nozzles, the liquid droplet hardly enters the second area. Therefore, it is easy to move the ink droplet in the direction to make separation from the nozzles.

The nozzle array may include a plurality of arrays; and fourth areas and fifth areas which are adjacent to the fourth areas and which have liquid repellence higher than that of the fourth areas may be formed between two of the third areas formed for the nozzles which constitute adjoining two arrays, both of the fourth areas and the fifth areas being formed alternately in an extending direction of the nozzle array while extending in a direction perpendicular to the extending direction of the nozzle array. In this arrangement, each of the all fifth areas formed between two of the third areas may be established such that a liquid droplet, which exists in a fourth area of the fourth areas adjacent to a fifth area of the fifth areas on one side in the extending direction of the nozzle array, requires a force to enter the fifth area, and a liquid droplet, which exists in a fourth area adjacent to a fifth area on the other side in the extending direction of the nozzle array, requires a force to enter the fifth area, the former force being smaller than the latter force. Alternatively, the nozzle array may include a plurality of arrays; and fourth areas and fifth areas which are adjacent to the fourth areas and which have liquid repellence higher than that of the fourth areas may be formed between two of the third areas formed for the nozzles which constitute adjoining two arrays, both of the fourth areas and the fifth areas being formed alternately in an extending direction of the nozzle array while extending in a direction perpendicular to the extending direction of the nozzle array. In this arrangement, a first group of mutually adjoining fifth areas of the fifth areas, which includes one of two fifth areas formed on outermost sides in the extending direction of the nozzle array, of the all fifth areas formed between two of the third areas, may be established such that a liquid droplet, which exists in a fourth area of the fourth areas adjacent inwardly to a fifth area in the extending direction of the nozzle array, requires a force to enter the fifth area, and a liquid droplet, which exists in a fourth area adjacent outwardly to a fifth area in the extending direction of the nozzle array, requires a force to enter the fifth area, the former force being smaller than the latter force; and a second group of mutually adjoining fifth areas, which includes the other of the two fifth areas formed on the outermost sides in the extending direction of the nozzle array, may be established such that a liquid droplet, which exists in a fourth area adjacent inwardly to a fifth area in the extending direction of the nozzle array, requires a force to enter the fifth area, and a liquid droplet, which exists in a fourth area adjacent outwardly to a fifth area in the extending direction of the nozzle array, requires a force to enter the fifth area, the former force being smaller than the latter force. Accordingly, even when the plurality of nozzle arrays extend while being separated from each other, it is possible to distance the liquid droplets from the respective nozzle arrays.

In the present invention, the liquid droplet-ejecting apparatus may further comprise a liquid droplet-absorbing member which is arranged at a position which is farther from the nozzle array than that of the second area formed farthest from the nozzle array. Further, in this arrangement, liquid droplet-absorbing members may be arranged outside the second area formed at an outermost position and outside the fifth area formed at an outermost position respectively. Accordingly, the liquid droplets, which have been moved in the direction to make separation from the nozzles, can be absorbed by the liquid droplet-absorbing member. Therefore, it is possible to avoid any dripping of the liquid droplet from the liquid droplet discharge surface.

According to a fourth aspect of the present invention, there is provided a liquid droplet-moving apparatus for moving liquid droplets adhered to a liquid droplet-adhering surface by utilizing a wind force or an inertial force, comprising first areas and a second area which has liquid repellence higher than that of the first areas, the first and second areas being alternately formed adjacently without any gap in a predetermined direction on the liquid droplet-adhering surface. In this arrangement, a liquid droplet, which exists in one of the first areas adjacent to the second area on a side directed in the predetermined direction, requires a first force to enter the second area, and a liquid droplet, which exists in the other of the first areas adjacent to the second area on a side directed oppositely to the predetermined direction, requires a second force to enter the second area, the first force being smaller than the second force. Accordingly, the liquid droplets, which are adhered to the liquid droplet-adhering surface, for example, by the inertial force and the force received by the air, can be moved in the predetermined direction. It is possible to remove the liquid droplets adhered to the liquid droplet-adhering surface from the liquid droplet-adhering surface.

According to a fifth aspect of the present invention, there is provided a liquid droplet-ejecting apparatus comprising: a liquid droplet discharge surface; a nozzle which is formed on the liquid droplet discharge surface and which discharges a liquid; a first area which is formed on the liquid droplet discharge surface; and a second area which is formed in the first area formed on the liquid droplet discharge surface, and which has liquid repellence higher than that of the first area, wherein a liquid droplet, which exists in the first area at a position nearer to the nozzle than the second area, requires a first force to enter the second area, and a liquid droplet, which exists in the first area at a position farther from the nozzle than the second area, requires a second force to enter the second area, the first force being smaller than the second force.

In the present invention, the second area may have an annular shape and surround the nozzle.

In the present invention, the first area may have an annular shape and surround the nozzle.

In the present invention, a third area which has a same liquid repellence as that of the second area may exist on a side nearer to the nozzle than the second area, and the first area may exist between the second area and the third area.

In the present invention, a boundary, which is disposed between the first area and the third area, may be defined by a straight line or a smooth curved line.

In the present invention, a boundary, which is disposed between the second area and the first area existing between the second area and the third area, may be defined by a zigzag line; and a boundary, which is disposed between the second area and the first area on a side opposite to the boundary defined by the zigzag line, may be defined by a straight line or a smooth curved line.

In the present invention, a plurality of zones, which have liquid repellence higher than that of the first area, may be provided in a boundary which is disposed between the second area and the first area existing between the second area and the third area so that the liquid repellence is increased in a stepwise manner as a zone position is positioned farther from the nozzle.

In the present invention, a large number of portions, which have liquid repellence lower than that of the second area, may be formed in a boundary which is disposed between the second area and the first area existing between the second area and the third area, and the portions having lower liquid repellence in the boundary may have an average density which is gradually decreased in a direction which makes separation from the nozzle.

In the present invention, a large number of portions, which have liquid repellence higher than that of the second area, may be formed in a boundary which is disposed between the second area and the first area existing between the second area and the third area, and the portions having higher liquid repellence in the boundary may have an average density which is gradually increased in a direction which makes separation from the nozzle.

The liquid droplet-ejecting apparatus may further comprise a liquid-absorbing member which is arranged in the liquid droplet discharge surface at a position which is farther from the nozzle than the first, second and third areas.

In the present invention, the nozzle may include a plurality of nozzle holes, the second area may include annular areas which are formed in surroundings of the nozzles holes respectively, and the annular areas may be connected to one another by liquid-repellent connecting portions.

In the present invention, each of the connecting portions may have a zigzag pattern formed on a predetermined side thereof.

BRIEF DESCRIPTION OF THE DRAWINGS

FIG. 5 shows magnified views illustrating the ink discharge surface shown in FIG. 4, wherein

DESCRIPTION OF THE PREFERRED EMBODIMENTS

First Embodiment

A preferred first embodiment of the present invention will be explained below with reference to the drawings.

Figure 1:
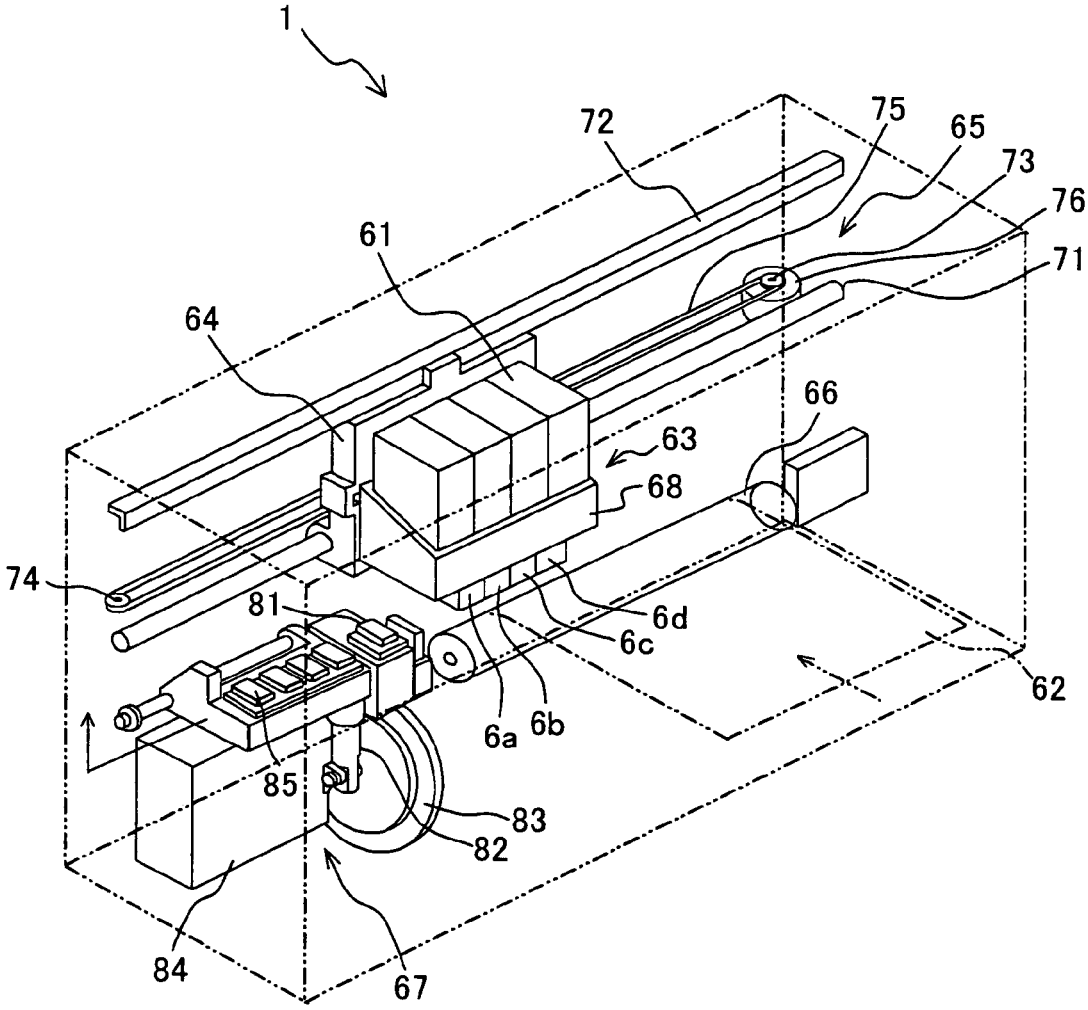
FIG. 1 shows a schematic perspective view depicting an internal structure of a color ink-jet printer according to a first embodiment of the present invention.

FIG. 1 shows a schematic perspective view depicting an internal structure of a color ink-jet printer according to this embodiment. With reference to FIG. 1, a head unit 63 is arranged in the color ink-jet printer 1. Four piezoelectric type ink-jet heads 6*a*, 6*b*, 6*c*, 6*d*, which discharge inks of yellow, magenta, cyan, and black respectively, are secured to a main body frame 68 of the head unit 63. Four ink cartridges in total, which are filled with the color inks respectively, are detachably attached to the main body frame 68. The main body frame 68 is secured to a carriage 64 which undergoes the reciprocating driving in the linear direction by a driving mechanism (reciprocating movement unit) 65. A platen roller 66, which serves as a transport unit for transporting a printing paper 62 as a recording medium, is arranged so that the axis of the platen roller 66 extends in the direction of the reciprocating movement of the carriage 64. The platen roller 66 is opposed to the ink-jet heads 6*a* to 6*d*.

The carriage 64 is slidably supported by a guide shaft 71 and a guide plate 72 which are arranged in parallel to the support shaft of the platen roller 66. Pulleys 73, 74 are supported in the vicinity of both ends of the guide shaft 71. An endless belt 75 is allowed to run between the pulleys 73, 74. The carriage 64 is fixed at an appropriate position of the endless belt 75.

In the driving mechanism 65 constructed as described above, when one pulley 73 is rotated in the forward or reverse direction, the carriage 64 makes the reciprocating movement in the linear direction along the guide shaft 71 and the guide plate 72. Therefore, the head unit 63 also makes the reciprocating movement in accordance therewith.

The printing paper 62 is fed from a paper feed cassette (not shown) which is provided on the side of the ink-jet printer 1. The printing paper 62 is introduced into the space between the ink-jet heads 6*a* to 6*d* and the platen roller 66. The printing paper 62 is subjected to the printing with the inks discharged from the ink-jet heads 6*a* to 6*d*, and then the printing paper 62 is discharged. A paper feed mechanism and a paper discharge mechanism for the printing paper 62 are omitted from the illustration in FIG. 1.

A purge mechanism 67, which is depicted in a lower-left part as viewed in FIG. 1, is provided in the ink-jet printer 1. The purge mechanism 67 is provided in order to forcibly suck and remove defective inks containing, for example, bubbles and dust stored in the respective ink-jet heads 6*a* to 6*d*. The purge mechanism 67 is provided on the side of the platen roller 66. The position of the purge mechanism 67 is determined so that the purge mechanism 67 is successively opposed to any one of the four ink-jet heads 6*a* to 6*d* when the head unit 63 arrives at the reset position by the aid of the driving mechanism 65. The purge mechanism 67 is provided with a purge cap 81. The purge cap 81 abuts against the lower surface of any one of the ink-jet heads 6*a* to 6*d* so that a large number of nozzles 109 (see FIG. 2), which are provided on the lower surface of each of the ink-jet heads 6*a* to 6*d*, are covered therewith.

In this arrangement, the nozzles 109 of any one of the ink-jet heads 6*a* to 6*d* are covered with the purge cap 81 when the head unit 63 is disposed at the reset position. The defective ink, which contains bubbles or the like remaining in the ink-jet head 6*a* to 6*d*, is sucked by a pump 82 in accordance with the driving of a cam 83, and the defective ink is discarded into a drain ink reservoir 84. Accordingly, the ink-jet heads 6*a* to 6*d* are restored. The operation as described above is successively performed for the four ink-jet heads 6*a* to 6*d*. Accordingly, it is possible to remove bubbles upon the initial introduction of the inks into the ink-jet heads 6*a* to 6*d*. Further, the ink-jet heads 6*a* to 6*d* can be restored to the normal state from any discharge failure state which has been suffered by the ink-jet heads 6*a* to 6*d*, for example, due to the growth of internal bubbles caused by the printing operation. Four caps 85 shown in FIG. 1 are provided in order to prevent the inks from being dried by covering the large number of nozzles 109 of the ink-jet heads 6*a* to 6*d* corresponding thereto on the carriage 64 to be returned to the reset position after the completion of the printing operation.

Figure 2:
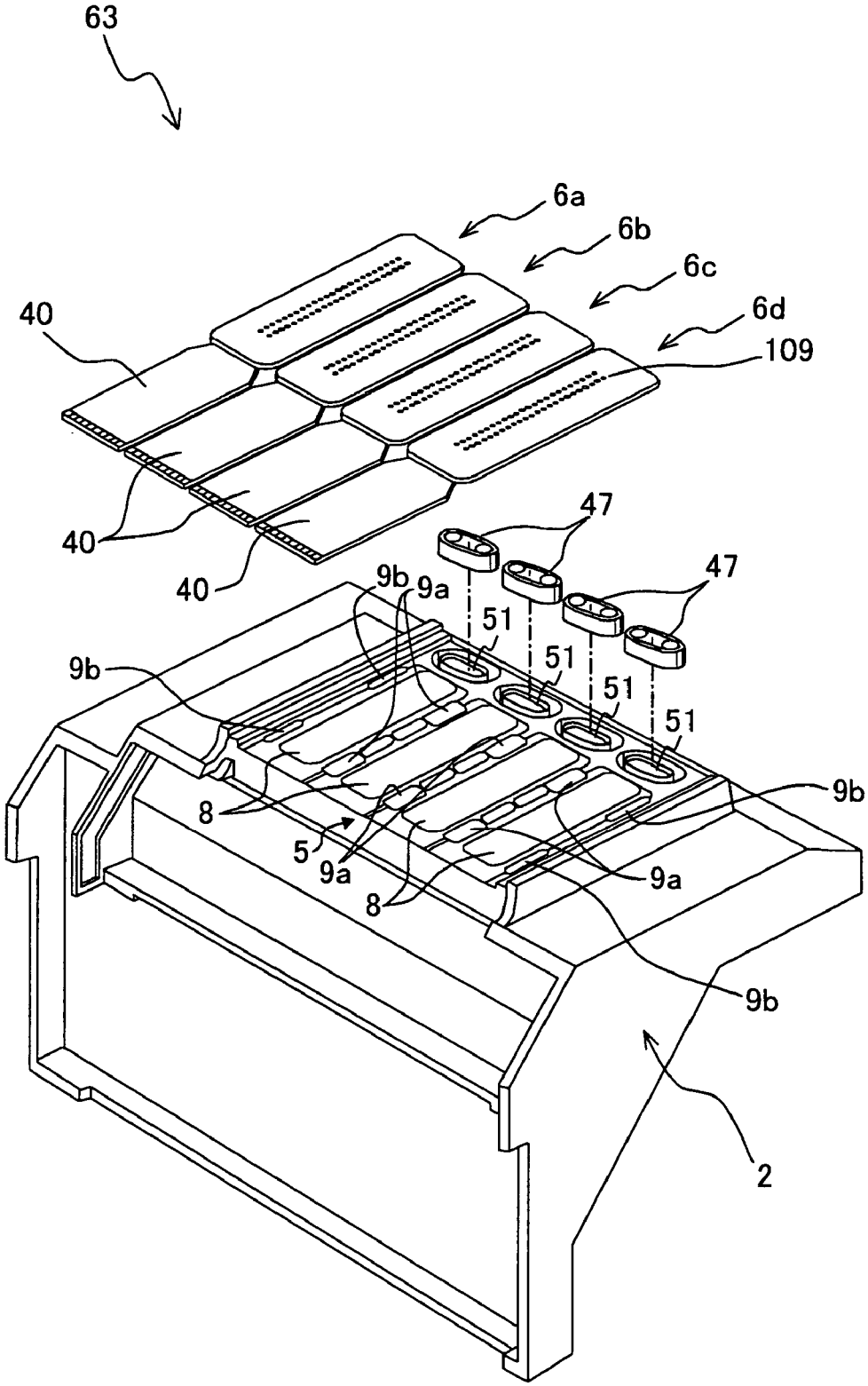
FIG. 2 shows a perspective view illustrating a state in which a head unit shown in FIG. 1 is placed upside down.

FIG. 2 shows a perspective view illustrating a state in which the head unit 63 is placed upside down. As shown in FIG. 2, the main body frame 68 of the head unit 63 is formed to be substantially box-shaped, which is open on the upper surface side (depicted so that the upper surface side is directed downwardly in FIG. 2). Accordingly, a carrying section is formed, to which the four ink cartridges 61 can be detachably installed from the open side.

Four ink supply passages 51, which are communicated to the side of the upper surface from the side of the lower surface (surface on the side on which the ink-jet heads 6*a* to 6*d* are secured; the surface is depicted to be directed upwardly in FIG. 2) of a bottom plate 5 of the main body frame 68 and which can be connected to ink release sections of the respective ink cartridges 61, are provided on one side of the carrying section of the main body frame 68. Joint members 47 made of rubber or the like, which are capable of making tight contact with ink supply ports (not shown) of the respective ink-jet heads 6*a* to 6*d*, are attached to the lower surface of the bottom plate 5 while corresponding to the respective ink supply passages 51.

As shown in FIG. 2, four support sections 8, which are provided to arrange the four ink-jet heads 6*a* to 6*d* in parallel, are formed as stepped recesses on the lower surface side of the bottom plate 5. A plurality of hollow spaces 9*a*, 9*b*, which are provided to fix the corresponding ink-jet heads 6*a* to 6*d* with an UV-curable adhesive, are formed for the respective support sections 8 to penetrate vertically.

Figure 3:
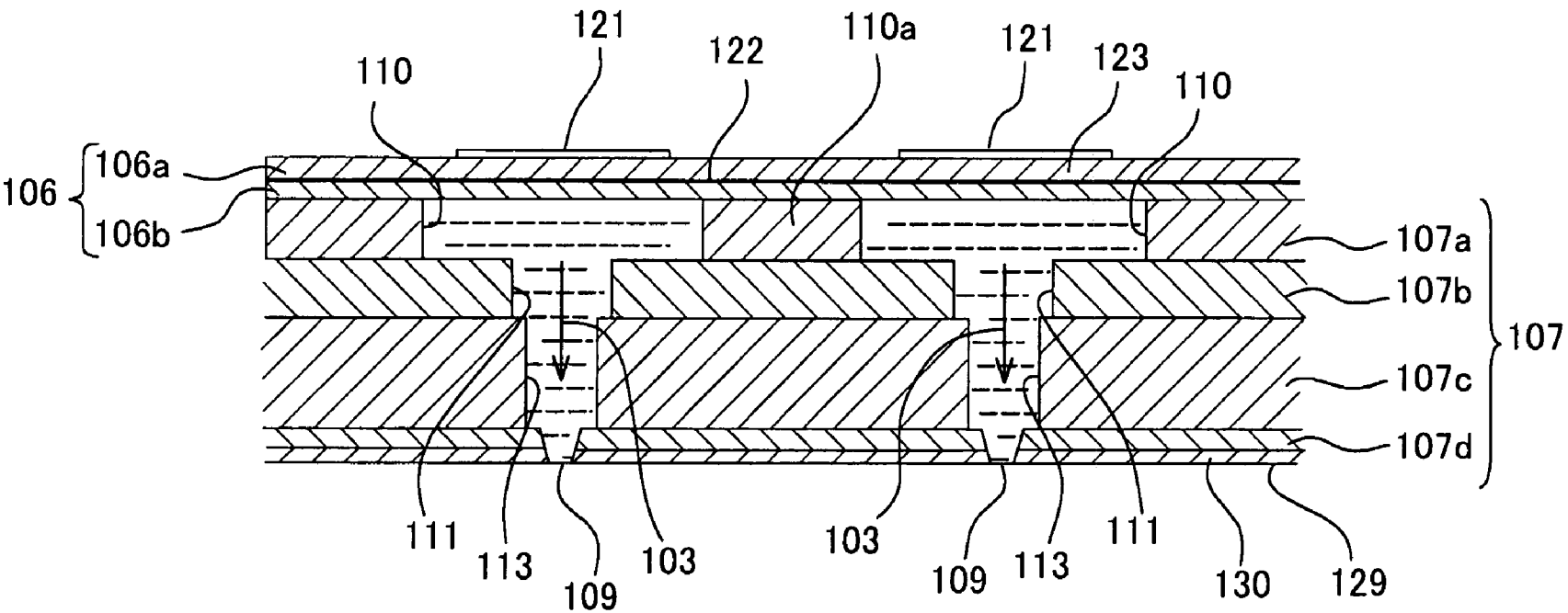
FIG. 3 shows a partial sectional view illustrating an ink-jet head shown in FIG. 2.

FIG. 3 shows a partial sectional view illustrating the ink-jet head 6*a*. Since the four ink-jet heads 6*a* to 6*d* are constructed identically, explanation only for one ink-jet head 6*a* will be given below. As shown in FIG. 3, the ink-jet head 6*a* includes an actuator unit 106 which is driven by a driving signal supplied from an unillustrated control unit, and a flow passage unit 107 which forms ink flow passages, the actuator unit 106 and the flow passage unit 107 being stacked. The actuator unit 106 and the flow passage unit 107 are adhered to one another by the aid of an epoxy thermosetting adhesive. FPC 40 is joined to the upper surface of the actuator unit 106. However, FPC 40 is not depicted in FIG. 3 in order to simplify the illustration.

The flow passage unit 107 is constructed by stacking three thin plate-shaped plates (cavity plate 107*a*, spacer plate 107*b*, manifold plate 107*c*), each of which has a substantially rectangular flat shape composed of a metal material, and a nozzle plate 107*d* which is provided with nozzles 109 for discharging the ink and which is made of a synthetic resin such as polyimide. The cavity plate 107*a*, which is disposed at the uppermost position, makes contact with the actuator unit 106.

A plurality of pressure chambers 110, which accommodate the ink to be selectively discharged in accordance with the operation of the actuator unit 106, are formed in two arrays in the longitudinal direction on the surface of the cavity plate 107*a*. The plurality of pressure chambers 110 are comparted from each other by partition walls 110*a*, and they are arranged and aligned in parallel in the longitudinal direction. The spacer plate 107*b* is formed with communication holes 111 each of which allows one end of the pressure chamber 110 to make communication with the nozzle 109, and communication holes (not shown) each of which allows the other end of the pressure chamber 110 to make communication with an unillustrated manifold flow passage.

The manifold plate 107*c* is formed with communication holes 113 each of which allows one end of the pressure chamber 110 to make communication with the nozzle 109. The manifold plate 107*c* further includes the manifold flow passages for supplying the ink to the respective pressure chambers 110, the manifold flow passages being formed under the arrays formed by the plurality of pressure chambers 110 to extend long in the array direction. One end of each of the manifold flow passages is connected to the ink cartridge 61 via the ink supply passage 51 shown in FIG. 2. As shown in FIG. 2, the plurality of nozzles 109, which are arranged in two arrays in a zigzag form in the extending direction of the nozzle plate 107*d*, are formed through the nozzle plate 107*d*. As shown in FIG. 3, a water-repellent layer 130, which is composed of a fluororesin, is formed on the lower surface (ink discharge surface) 129 of the nozzle plate 107*d*. The respective plates 107*a* to 107*d* as described above are positioned and stacked so that individual ink flow passages 103 are formed to extend from the manifold flow passages via the unillustrated communication holes, the pressure chambers 110, the communication holes 111, and the communication holes 113 to the nozzles 109. Thus, the flow passage unit 107, which has the rectangular flat shape, is constructed to extend in the direction (direction parallel to the printing paper feed direction) perpendicular to the direction of the reciprocating movement of the head unit 63.

Two piezoelectric ceramics plates 106*a*, 106*b*, each of which is composed of a ceramics material of lead titanate zirconate (PZT), are stacked in the actuator unit 106. Individual electrodes 121 are arranged at positions at which the individual electrodes 121 are overlapped within ranges corresponding to the pressure chambers 110 of the flow passage unit 107 on the upper surface of the piezoelectric ceramics plate 106*a*. A common electrode 122 is arranged between the piezoelectric ceramics plate 106*a* and the piezoelectric ceramics plate 106*b* so that the common electrode 122 extends over all of the pressure chambers 110 of the flow passage unit 107.

The common electrode 122 is always retained at the ground electric potential. On the other hand, the driving signal is applied to the individual electrodes 121. The interposed area of the piezoelectric ceramics plate 106*a*, which is interposed between the common electrode 122 and the individual electrode 121, serves as an active section 123 which is to be polarized in the stacking direction by previously applying the electric field to the interposed area by using the electrodes. Therefore, when the electric potential of the individual electrode 121 becomes a positive predetermined electric potential, the electric field is applied to the active section 123 of the piezoelectric ceramics plate 106*a* so that the active section 123 may be elongated in the stacking direction. However, the lower surface of the piezoelectric ceramics plate 106*b* is fixed to the upper surface of the partition wall 110*a* which comparts the pressure chamber 110. Therefore, the piezoelectric ceramics plates 106*a*, 106*b* are consequently deformed to be convex toward the pressure chamber 110. Accordingly, the volume of the pressure chamber 110 is decreased, the ink pressure is increased, and the ink is discharged from the nozzle 109.

Figure 4:
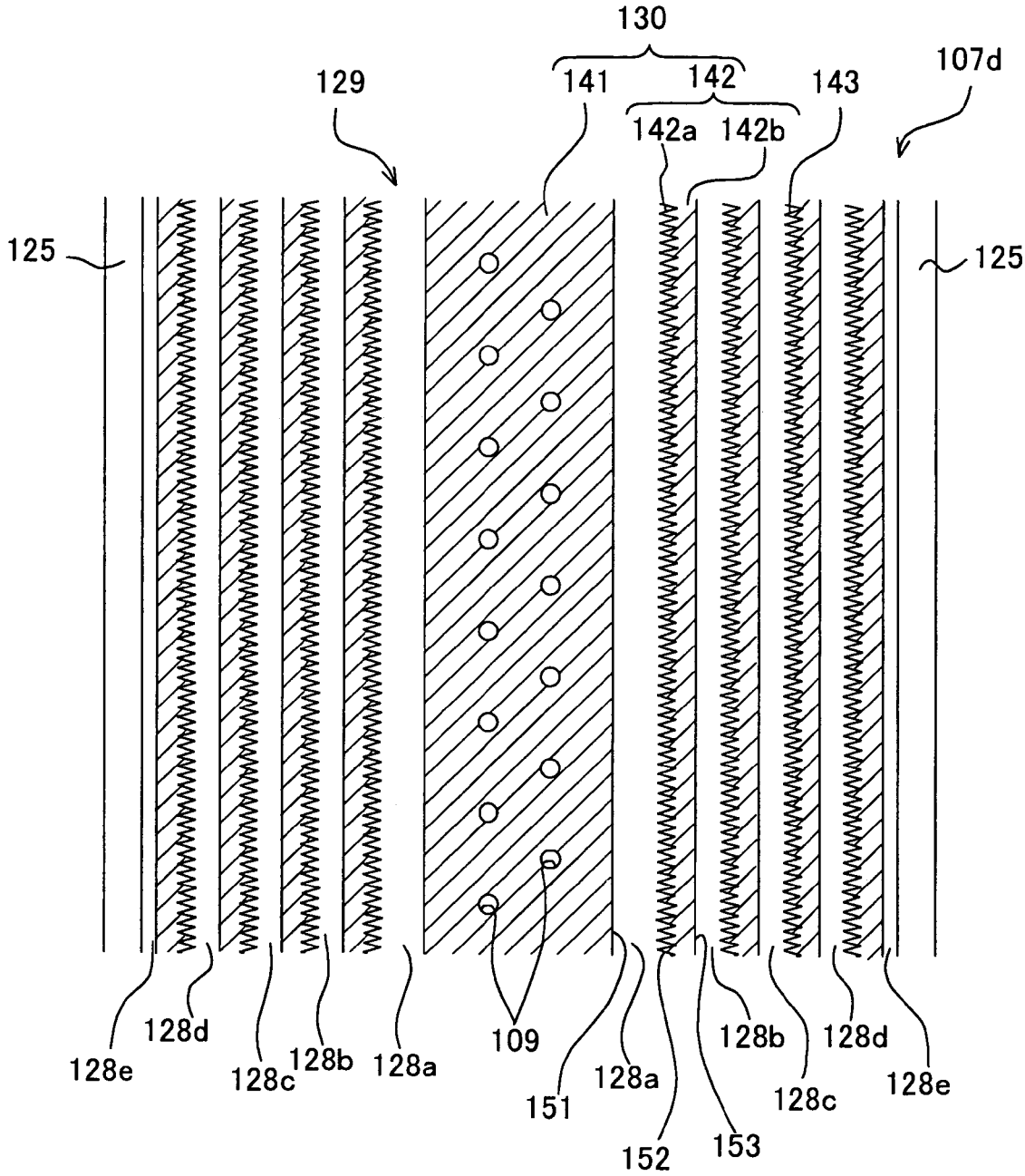
FIG. 4 shows a magnified plan view illustrating an ink discharge surface of a nozzle plate shown in FIG. 3.

Next, an explanation will be made below about the ink discharge surface 129 of the nozzle plate 107*d*. FIG. 4 shows a magnified plan view illustrating the ink discharge surface 129 of the nozzle plate 107*d* shown in FIG. 3. As shown in FIG. 4, those formed on the ink discharge surface 129 of the nozzle plate 107*d* include the water-repellent layer 130 and ink-absorbing members 125 composed of a material of sponge or the like capable of absorbing the ink. The ink-absorbing members 125 extend in parallel to the extending direction (vertical direction as viewed in FIG. 4) of the ink discharge surface 129, and are arranged at both ends of the ink discharge surface 129 as shown in FIG. 4.

The water-repellent layer 130 includes a first water-repellent layer (third area) 141 which is formed in the vicinity of the nozzles 109, and eight second water-repellent layers (second areas) 142 four of which are arranged on the left and right sides of the first water-repellent layer 141 respectively and which extend in parallel to the extending direction of the ink discharge surface 129. The first water-repellent layer 141 and the second water-repellent layer 142 have the same water repellence. The first water-repellent layer 141 extends in the direction of the two nozzle arrays formed by the plurality of nozzles 109. The plurality of nozzles 109, which are formed in the two arrays in the zigzag form, exist at the inside of the first water-repellent layer 141. In other words, the first water-repellent layer 141 is formed so that all of the surroundings of the plurality of nozzles 109 are thoroughly covered therewith. The eight second water-repellent layers 142 are arranged while being isolated from each other in the direction perpendicular to the extending direction of the ink discharge surface 129. A plurality of areas in which the water-repellent layers 130 are not formed, i.e., hydrophilic areas (first areas) 128*a* to 128*e* are formed on the ink discharge surface 129. The hydrophilic areas 128*a* exist between the first water-repellent layer 141 and the second water-repellent layers 142, the hydrophilic areas 128*b* to 128*d* exist between the second water-repellent layers 142, and the hydrophilic areas 128*e* exist between the second water-repellent layers 142 and the ink-absorbing members 125. In other words, the second water-repellent layers 142 and the hydrophilic areas 128*a* to 128*e* are alternately arranged on the ink discharge surface 129 in an order of the first water-repellent layer 141, the hydrophilic area 128*a*, the second water-repellent layer 142, the hydrophilic area 128*b*, and the second water-repellent layer 142 . . . in the direction directed from the nozzles 109 to the ink-absorbing member 125.

As shown in FIG. 4, the both ends of the first water-repellent layer 141 on the left and right sides are formed so that boundary lines 151 between the first water-repellent layer 141 and the hydrophilic areas 128*a* are straight lines which are parallel to the extending direction of the ink discharge surface 129. Ends 142*a* of the second water-repellent layers 142 on the sides of the first water-repellent layer 141 are formed such that a plurality of inclined sections 143, which are symmetrically inclined in relation to the extending direction of the flow passage unit 107, are provided continuously in the extending direction of the ink discharge surface 129 so that boundary lines 152 between the second water-repellent layers 142 and the hydrophilic areas 128*a* to 128*d* have zigzag shapes. The inclined sections 143 are formed by cutting out parts of the ends 142*a* of the second water-repellent layers 142 by the laser machining. On the other hand, ends 142*b* of the second water-repellent layers 142 on the sides of the ink-absorbing members 125 are formed so that boundary lines 153 between the second water-repellent layers 142 and the hydrophilic areas 128*b* to 128*e* are straight lines which are parallel to the extending direction of the flow passage unit 107.

Figure 5A:
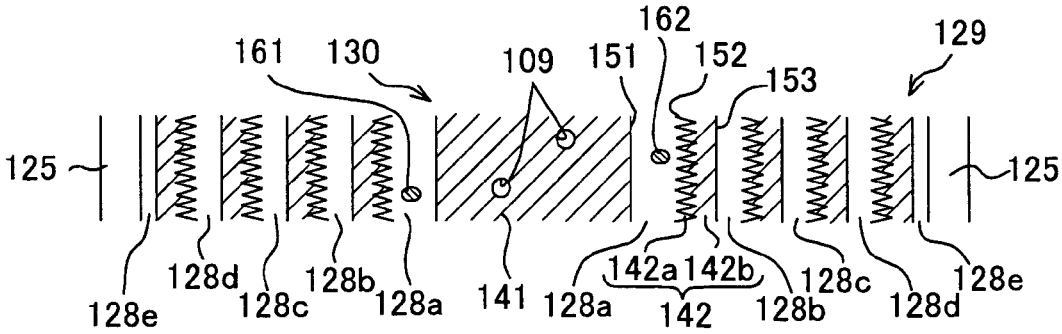
FIG. 5A shows a situation in which ink droplets adhere to the ink discharge surface.
Figure 5B:
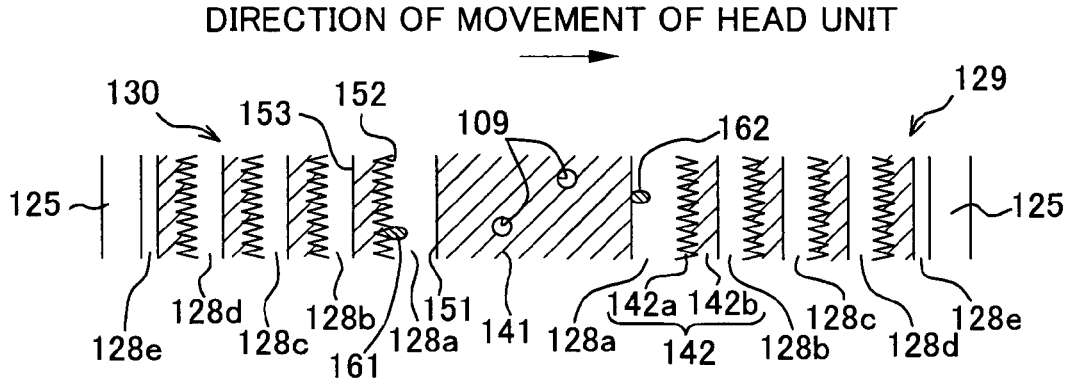
FIG. 5B shows a situation brought about before the ink droplet passes across a second water-repellent layer in accordance with the movement of the head unit in one direction.
Figure 5C:
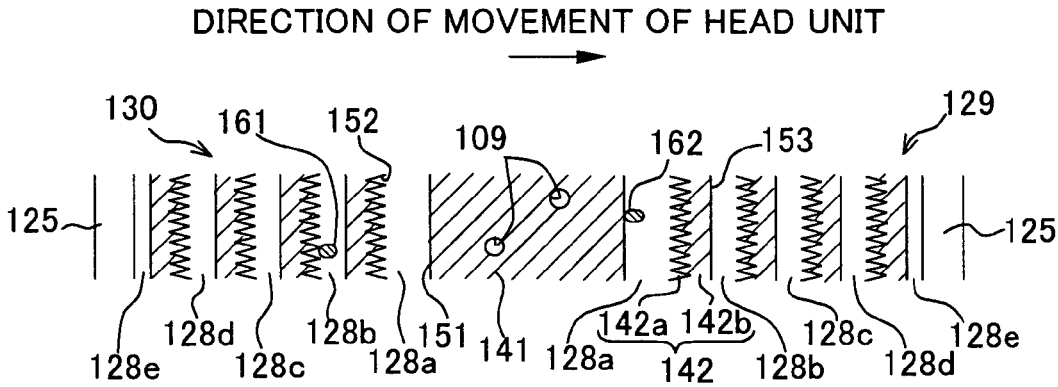
FIG. 5C shows a situation brought about after the ink droplet has passed across the second water-repellent layer in accordance with the movement of the head unit in one direction.
Figure 5D:
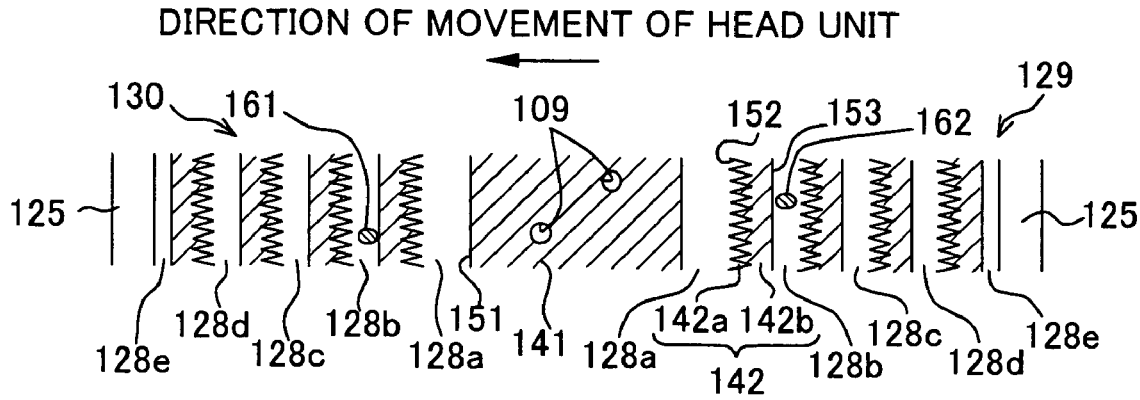
FIG. 5D shows a situation brought about after the ink droplet has passed across the second water-repellent layer in accordance with the movement of the head unit in the other direction.
Figure 5E:
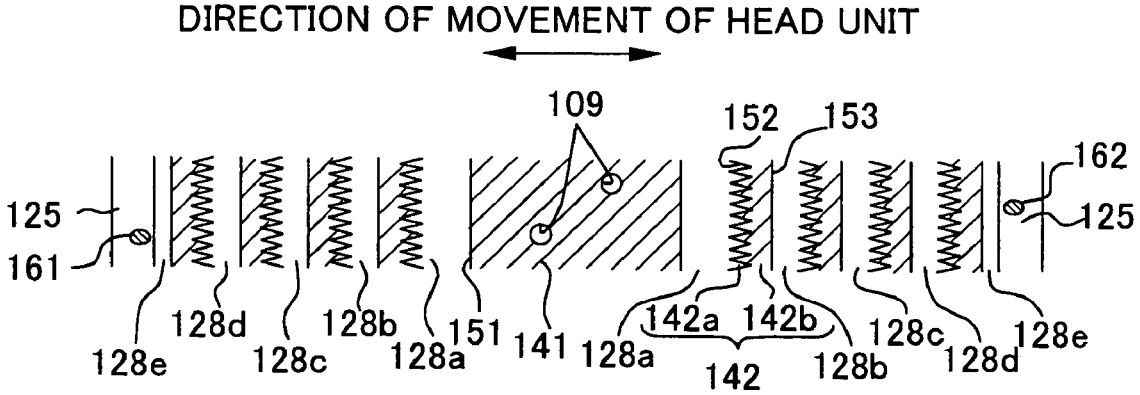
FIG. 5E shows a situation in which the ink droplets have moved onto ink-absorbing members.

Next, an explanation will be made below about the movement of ink droplets adhered to the ink discharge surface 129 in accordance with the reciprocating movement of the head unit 63. FIG. 5 shows magnified views illustrating the ink discharge surface shown in FIG. 4, wherein FIG. 5A shows a situation in which the ink droplets adhere to the ink discharge surface 129, FIG. 5B shows a situation brought about before the ink droplet passes across the second water-repellent layer 142 in accordance with the movement of the head unit 63 in one direction (movement in the rightward direction as viewed in FIG. 5), FIG. 5C shows a situation brought about after the ink droplet has passed across the second water-repellent layer 142 in accordance with the movement of the head unit 63 in one direction, FIG. 5D shows a situation brought about after the ink droplet has passed across the second water-repellent layer in accordance with the movement of the head unit 63 in the other direction (movement in the leftward direction as viewed in FIG. 5), and FIG. 5E shows a situation in which the ink droplets have moved onto the ink-absorbing members 125.

When the printing operation is performed on the printing paper 62, the ink droplets are discharged from the nozzles 109 while allowing the head unit 63 to make the reciprocating movement by the aid of the driving mechanism 65. During this process, for example, as shown in FIG. 5A, it is assumed that two ink droplets 161, 162 are adhered onto the hydrophilic areas 128*a* between the first water-repellent layer 141 and the second water-repellent layers 142 on the ink discharge surface 129, for example, due to the ink mist or the rebound of the ink droplets from the printing paper 62. When the printing operation is continued on the printing paper 62 in the state in which the two ink droplets 161, 162 are adhered to the ink discharge surface 129, as shown in FIG. 5B, the adhered two ink droplets 161, 162 receive the force of inertia and/or the force of air or the like to move in the leftward direction as viewed in the drawing on the ink discharge surface 129 when the head unit 63 is moved rightwardly as viewed in the drawing. The ink droplet 161 makes contact with the second water-repellent layer 142, and the ink droplet 162 makes contact with the first water-repellent layer 141. In this situation, the ink droplet 162, which has made contact with the first water-repellent layer 141, stops on the boundary line 151, for the following reason. That is, the ink droplet 162 is repelled by the water-repellent layer 141 in the same direction as the direction of movement of the head unit 63. Further, the boundary line 151 is the straight line. Therefore, the rising angle of the ink droplet 162 from the ink discharge surface 129 on the boundary line 151 is identical at any position, which does not exceed the critical angle (i.e., the angle at which the ink meniscus of the ink droplet is broken to enable the ink droplet to move onto the water-repellent layer).

The force, which is required for the ink droplet 162 to move on the ink discharge surface 129, relates to the reciprocating movement velocity and the acceleration of the head unit 63 (i.e., relates such that the wind force and the inertial force received by the ink droplet are increased when the reciprocating movement velocity and the acceleration of the head unit 63 are large, while the wind force and the inertial force received by the ink droplet are decreased when the reciprocating movement velocity and the acceleration of the head unit 63 are small). In this embodiment, the reciprocating movement velocity and the acceleration of the head unit 63 are adjusted so that the rising angle of the ink droplet 162 from the ink discharge surface 129 is an angle of such an extent that the critical angle is not exceeded on the boundary line 151. Therefore, the movement of the ink droplet 162 stops on the boundary line 151, and the ink droplet 162 does not migrate onto the first water-repellent layer 141.

Figure 12A:
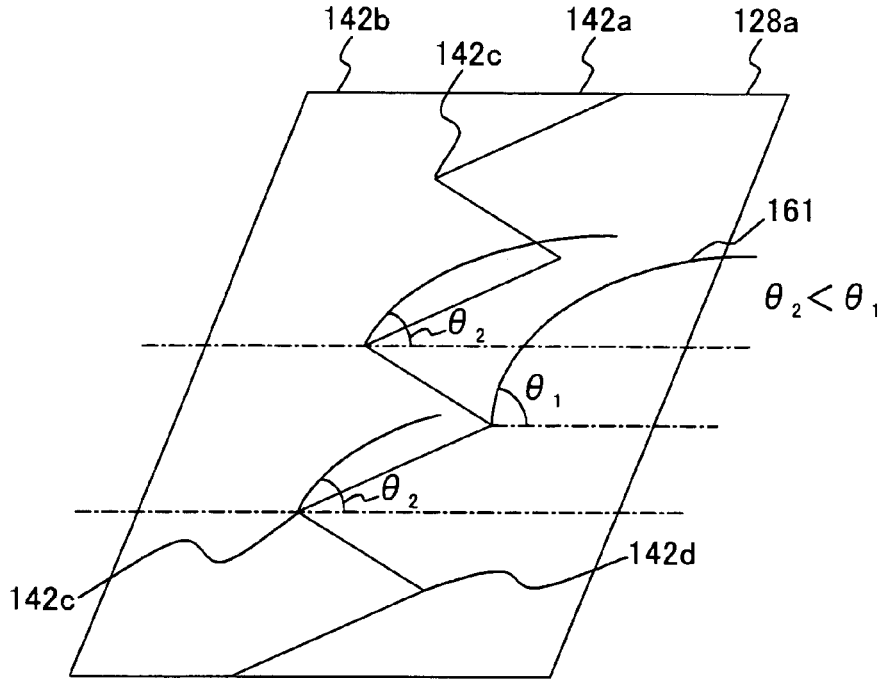
FIGS. 12A and 12B illustrate the principle of the passage of the ink droplets across the second water-repellent layer in the first embodiment of the present invention.
Figure 12B:
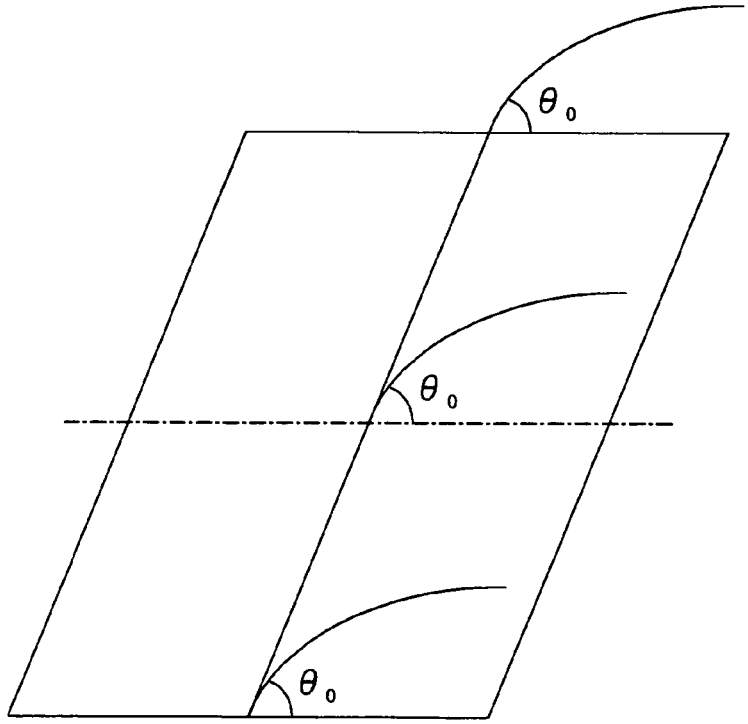

On the other hand, the ink droplet 161, which has made contact with the second water-repellent layer 142, intends to ride over the boundary line 152. The reason thereof will be explained with reference to FIGS. 12A and 12B. FIG. 12A shows a magnified view illustrating those disposed in the vicinity of the boundary (boundary line 152) between the end 142*a* of the second water-repellent layer 142 and the hydrophilic area 128*a*. The end 142*a* of the second water-repellent layer 142 is formed to have the zigzag shape. Therefore, the ink droplets 161, which have been advanced to the end 142*a*, stay at different angles depending on the positions of the zigzag shape. That is, the contact angle θ1 (rising angle of the ink meniscus of the ink droplet 161), which is obtained at the tip 142*d* of the zigzag shape of the end 142*a* (on the side far from the nozzles 109), is larger than the contact angle θ2 of the liquid which is obtained at the bottom 142*c* of the zigzag shape of the end 142*a* (on the side near to the nozzles 109), for the following reason. That is, the larger contact angle can be maintained at the tip 142*d* of the zigzag shape by the aid of the surface tension, because the liquid exists on the both sides of the tip 142*d*. Therefore, when the ink droplet 161 approaches the boundary between the end 142*a* and the hydrophilic area 128*a*, and the force in the leftward direction, which facilitates the ink droplet 161 to transfer to the second water-repellent layer 142, is applied to the ink droplet 161, then the contact angle is increased at the tip 142*d* of the zigzag shape as compared with other portions to arrive at the critical angle with ease. On the contrary, as shown in FIG. 12B, when the boundary is a straight line, the contact angle θ0 is identical at any position. Therefore, the liquid arrives at the critical angle earlier in the case of FIG. 12A than in the case of FIG. 12B, and the liquid enters the end 142*a* of the second water-repellent layer 142.

The boundary line 153 is formed so that the spacing distance is about 5 to 10 μm between the tip portions disposed near to the side of the nozzles 109, of the end 142*a* of the second water-repellent layer 142. Accordingly, on condition that the ink droplet 161, 162 has an ink droplet diameter of at least not less than 5 μm, the ink droplet 161, 162 makes contact with at least one or more tip portions of the end 142*a* on the boundary line 152 as described above to arrive at the critical angle, and the ink droplet 161, 162 is moved onto the second water-repellent layer 142. If the ink droplet has a diameter of less than 5 μm, and the ink droplet is moved on the ink discharge surface 129 in accordance with the reciprocating movement of the head unit 63, then the ink droplet is accommodated between the tip portions of the end 142*a*, and the ink droplet 161, 162 hardly arrives at the critical angle. However, when the diameter of the ink droplet 161, 162 is less than 5 μm, then the ink droplet 161, 162 is hardly moved by the reciprocating movement of the head unit 63, and the ink droplet 161, 162 does not drip toward the printing paper, which would be otherwise caused by the self-weight of the ink droplet. In other words, when the ink droplet has a diameter of less than 5 μm, the ink droplet hardly exerts any harmful influence.

When the force (first force), which is required for the ink droplet to ride over the boundary line 152 and move onto the second water-repellent layer 142, is smaller than the force (second force) which is required for the ink droplet to ride over the boundary line 151 to move onto the first water-repellent layer 141, it is possible to firstly stop the ink droplet 161 on the boundary line 152 without allowing the ink droplet 161 to ride over the boundary line 152.

However, in this embodiment, the reciprocating movement velocity and the acceleration of the head unit 63 in one direction is the same as the reciprocating movement velocity and the acceleration in the reverse other direction. The respective forces received by the ink droplets 161, 162 are the inertial force and the force of air or the like generated by the reciprocating movement of the head unit 63, which are approximately the same force. Further, the reciprocating movement velocity and the acceleration of the head unit 63 are adjusted as described above. However, the reciprocating movement velocity and the acceleration of the head unit 63 are adjusted so that the ink droplet 161 on the boundary line 152 exceeds the critical angle at the tip portion of the end 142*a* of the second water-repellent layer 142. Accordingly, the ink droplets 161, 162 receive approximately the same force in accordance with the movement on the ink discharge surface 129. Therefore, only the ink meniscus of the ink droplet 161 is broken at the tip portion on the side of the nozzles 109, of the end 142*a* on the boundary line 152. As shown in FIG. 5C, the ink droplet 161 rides over the second water-repellent layer 142, and it is moved to the hydrophilic area 128*b*.

As shown in FIG. 5D, when the head unit 63 is moved leftwardly, then the two adhered ink droplets 161, 162 receive the inertial force and the force of air or the like, and they are moved in the rightward direction on the ink discharge surface 129. The ink droplet 161 makes contact with the second water-repellent layer 142 on the boundary line 153 to stop the movement, and the ink droplet 162 is moved on the second water-repellent layer 142 to move to the hydrophilic area 128*b*. The ink droplet 161 is repelled by the second water-repellent layer 142 in the same direction as the direction of movement of the head unit 63. Further, the boundary line 153 is the straight line. Therefore, the rising angle of the ink droplet 161 from the ink discharge surface 129 on the boundary line 153 is the same angle at any position, which does not exceed the critical angle. Therefore, the movement is stopped on the boundary line 153. On the other hand, as for the ink droplet 162, the end 142*a* of the second water-repellent layer 142 is formed to have the zigzag shape. Therefore, as the force in the rightward direction to migrate to the second water-repellent layer 142 is applied to the ink droplet 162 after the ink droplet 162 approaches the boundary line 152, the rising angle of the ink meniscus of the ink droplet 162 is larger than those at other portions to arrive at the critical angle at the tip portion disposed near to the side of the nozzles 109 at the end 142*a* of the second water-repellent layer 142. As a result, only the ink meniscus of the ink droplet 162 is broken. As shown in FIG. 5D, the ink droplet 162 rides over the second-water-repellent layer 142, and it is moved to the hydrophilic area 128*b*.

As shown in FIG. 5E, when the head unit 63 is repeatedly moved in the leftward and rightward directions in accordance with the printing operation, then the two ink droplets 161, 162, which are adhered to the ink discharge surface 129, gradually become apart from the nozzles 109, and the two ink droplets 161, 162 are moved onto the ink-absorbing members 125 arranged at the both ends in the transverse direction of the ink discharge surface 129. The two ink droplets 161, 162, which have been moved onto the ink-absorbing members 125, are absorbed by the ink-absorbing members 125. Thus, it is possible to avoid the dripping of the ink droplets 161, 162 from the ink discharge surface 129.

As described above, the second water-repellent layer 142, which is formed on the ink discharge surface 129, includes the zigzag boundary line 152 which is formed at the end 142*a* disposed on the side near to the nozzles 109, and the boundary line 153 of the straight line which is formed at the end 142*b* disposed on the side far from the nozzles 109 and which is parallel to the extending direction of the flow passage unit 107. Therefore, the adhered ink droplets 161, 162 are moved in only the directions to make separation from the nozzles 109 during the reciprocating movement of the head unit 63. Further, the first water-repellent layer 141 is formed to thoroughly cover all of the surroundings of the nozzles 109. Further, the boundary line 151 between the first water-repellent layer 141 and the adjoining hydrophilic area 128*a* is the straight line which is parallel to the extending direction of the flow passage unit 107. Therefore, the ink droplets 161, 162 do not enter the nozzles 109.

Figure 6:
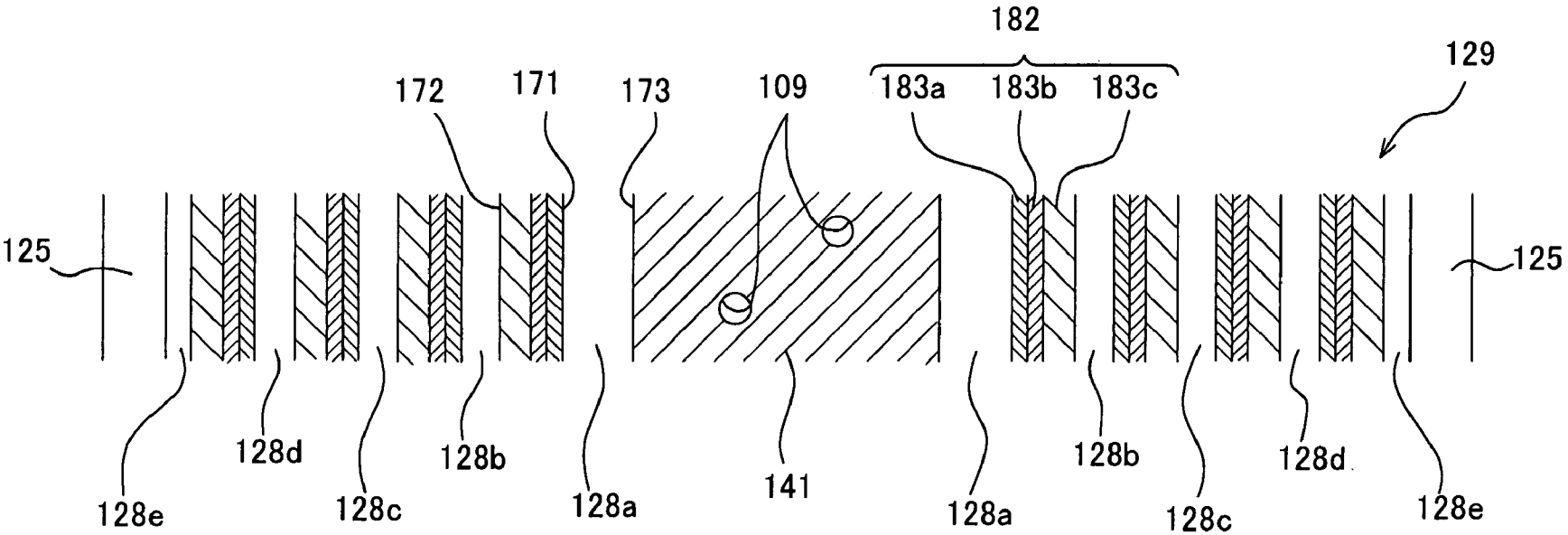
FIG. 6 shows a first modified embodiment of the second water-repellent layer formed on the ink discharge surface of the ink-jet head according to the first embodiment of the present invention.
Figure 7:
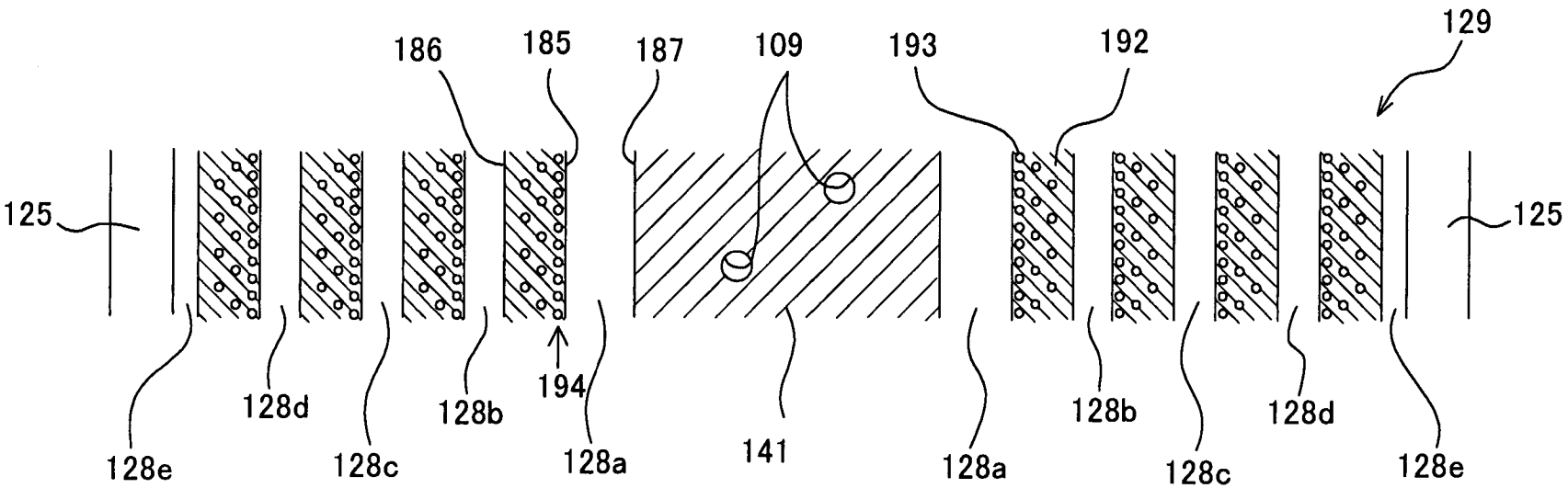
FIG. 7 shows a second modified embodiment of the second water-repellent layer formed on the ink discharge surface of the ink-jet head according to the first embodiment of the present invention.
Figure 8:
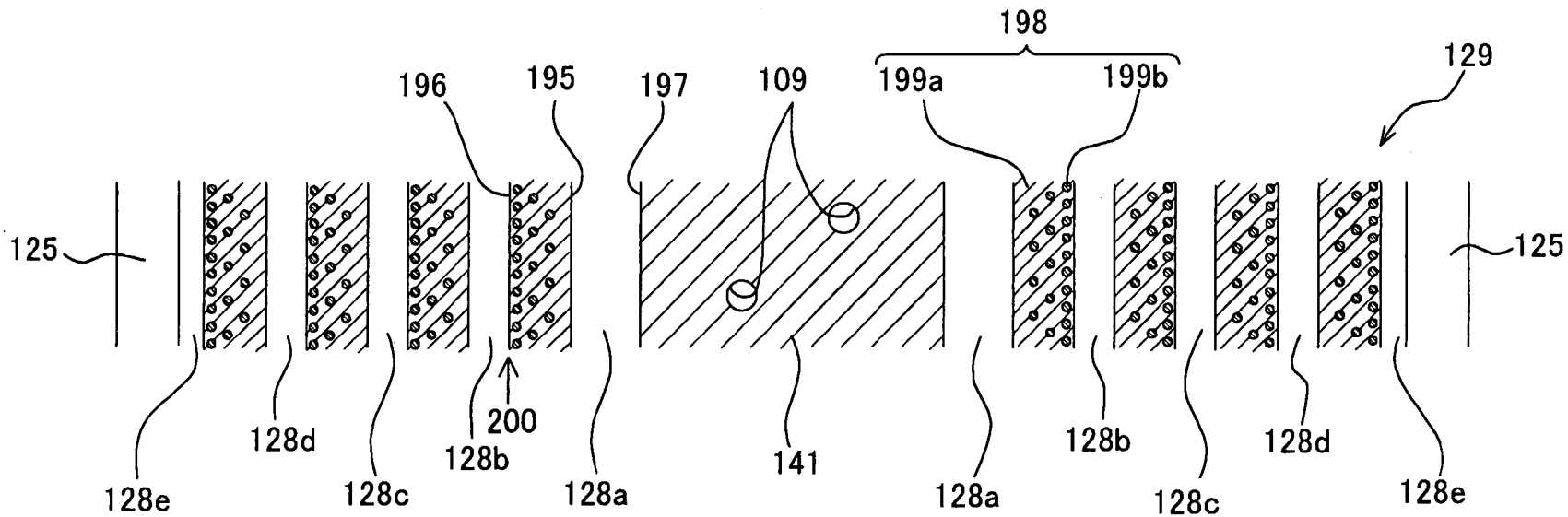
FIG. 8 shows a third modified embodiment of the second water-repellent layer formed on the ink discharge surface of the ink-jet head according to the first embodiment of the present invention.

The second water-repellent layer 142 of this embodiment has the zigzag shape of the end 142*a* disposed on the side near to the nozzles 109, and thus the ink droplets 161, 162 tend to move only in the directions to make separation from the nozzles 109. However, as shown in FIGS. 6 to 8, second water-repellent layers 182, 192, 198 may be formed according to first to third modified embodiments. FIG. 6 shows the first modified embodiment of the second water-repellent layer formed on the ink discharge surface of the head unit according to the first embodiment of the present invention. FIG. 7 shows the second modified embodiment of the second water-repellent layer formed on the ink discharge surface of the head unit according to the first embodiment of the present invention. FIG. 8 shows the third modified embodiment of the second water-repellent layer formed on the ink discharge surface of the head unit according to the first embodiment of the present invention.

As shown in FIG. 6, first to third water-repellent areas 183*a* to 183*c*, in which the water repellence is enhanced in a stepwise manner in the direction (left and right directions as viewed in FIG. 6) to make separation from the nozzles 109 from the end on the side of the first water-repellent layer 141, are formed in each of the second water-repellent layers 182 according to the first modified embodiment. The first water-repellent area 183*a* is formed on the side nearest to the nozzles 109 in the second water-repellent layer 182. The water repellence of the first water-repellent area 183*a* with respect to the ink droplets is smaller than those of the second and third water-repellent areas 183*b*, 183*c*. The second water-repellent area 183*b* is formed between the first and third water-repellent areas 183*a*, 183*c* in the second water-repellent layer 182. The water repellence of the second water-repellent area 183*b* with respect to the ink droplets is smaller than that of the third water-repellent area 183*c*. The third water-repellent area 183*c* is formed on the side farthest from the nozzles 109 in the second water-repellent layer 182. The water repellence of the third water-repellent area 183*c* with respect to the ink droplets is larger than those of the first and second water-repellent areas 183*a*, 183*b*. Further, the third water-repellent area 183*c* has the same water repellence as that of the first water-repellent layer 141.

Owing to this arrangement, the ink droplet, which is disposed on the boundary line 171 between the hydrophilic area 128*a* to 128*d* and the first water-repellent area 183*a* of the second water-repellent layer 182, easily arrives at the critical angle as compared with the ink droplet which is disposed on the boundary line 172 between the hydrophilic area 128*b* to 128*e* and the third water-repellent area 183*c* of the second water-repellent layer 182 and the ink droplet which is disposed on the boundary line 173 between the hydrophilic area 128*a* and the first water-repellent repellent layer 141. In other words, the upper limit of the critical angle of the ink droplet on the boundary line 171 is smaller than those on the other boundary lines 172, 173, because the water repellence of the first water-repellent area 183*a* is smaller than those of the second water-repellent area 183*b*, the third water-repellent area 183*c*, and the first water-repellent layer 141. Therefore, the ink droplet, which has received the same force in accordance with the reciprocating movement of the head unit 63, rides over the boundary line 171 from the hydrophilic areas 128*a* to 128*d*, but the ink droplet does not ride over the boundary lines 172, 173 from the hydrophilic areas 128*a* to 128*e*. As described above, the second water-repellent layer 182 according to the first modified embodiment also makes it possible to distance the ink droplets from the nozzles 109 in accordance with the reciprocating movement of the head unit 63 in the same manner as the second water-repellent layer 142 described above.

As shown in FIG. 7, a plurality of circular hydrophilic areas 193 are formed in each of the second water-repellent layers 192 according to the second modified embodiment. The hydrophilic areas 193 are formed in the second water-repellent layer 192 so that the number of the formed hydrophilic areas 193 is decreased in the direction (left and right directions as viewed in FIG. 7) to make separation from the nozzles 109 from the end on the side of the first water-repellent layer 141. In other words, the average density of the plurality of hydrophilic areas 193 of the second water-repellent layer 192 is decreased at positions farther from the side near to the first water-repellent layer 141. Further, a hydrophilic area array 194, in which a plurality of the hydrophilic areas 193 are arranged in the extending direction of the second water-repellent layer 192, is formed at the end of the second water-repellent layer 192 on the side of the first water-repellent layer 141. The hydrophilic area array 194 is formed at the position extremely near to the boundary line 185 between the second water-repellent layer 192 and the hydrophilic area 128*a*.

Owing to this arrangement, the ink droplet, which is disposed on the boundary line 185 between the second water-repellent layer 192 and the hydrophilic area 128*a* to 128*d*, easily rides over the boundary line 185 as compared with the ink droplet which is disposed on the boundary line 186 between the second water-repellent layer 192 and the hydrophilic area 128*b* to 128*e* and the ink droplet which is disposed on the boundary line 187 between the first water-repellent layer 141 and the hydrophilic area 128*a*. In other words, owing to the fact that the hydrophilic area array 194, which is formed by the plurality of hydrophilic areas 193, is formed at the end of the second water-repellent layer 192 on the side near to the first water-repellent layer 141, when the ink droplet, which exists in the hydrophilic area 128*a* to 128*d*, is moved to approach the boundary line 185, then the ink droplet makes contact with the hydrophilic area 193 belonging to the hydrophilic area array 194, and the hydrophilic area 193 attracts and introduces the ink droplet onto the second water-repellent layer 192. Accordingly, the ink droplet, which is disposed on the boundary line 185, easily arrives at the critical angle as compared with those disposed on the other boundary lines 186, 187. The ink droplet is moved on the second water-repellent layer 192 in the direction to make separation from the nozzles 109. The ink droplets, which are disposed on the boundary lines 186, 187, cannot be moved onto the second water-repellent layer 192 and the first water-repellent layer 141, because the hydrophilic area 193 is absent in the vicinity thereof. As described above, the second water-repellent layer 192 according to the second modified embodiment also makes it possible to distance the ink droplets from the nozzles 109 in accordance with the reciprocating movement of the head unit 63 in the same manner as the second water-repellent layer 142 described above. In this modified embodiment, the hydrophilic areas 193 are formed in the vicinity of the boundary line 185. However, the hydrophilic areas 193 may be arranged so that their centers are positioned on the boundary line 185. Accordingly, the boundary line 185 includes semicircular portions of the hydrophilic areas 193. Therefore, approximately the same function as that of the zigzag shape of the boundary line 152 described above is provided. Thus, it is possible to move the ink droplets onto the second water-repellent layer 192 with ease.

As shown in FIG. 8, each of the second water-repellent layers 198 according to the third modified embodiment includes a low water-repellent section 199*a* which has lower water repellence as compared with the first water-repellent layer 141, and a plurality of circular high water-repellent sections 199*b* which have high water repellence as compared with the low water-repellent section 199*a* and which have approximately the same water repellence as that of the first water-repellent layer 141. The high water-repellent sections 199*b* are formed in the second water-repellent layer 198 so that the number of the formed high water-repellent sections 199*b* is decreased in-the direction (left and right directions as viewed in FIG. 8) to make approach to the nozzles 109 from the outer end separated far from the first water-repellent layer 141. In other words, the average density of the high water-repellent sections 199*b* of the second water-repellent layer 198 is increased at positions separated farther from the side of the first water-repellent layer 141. A water-repellent section array 200, in which a plurality of the high water-repellent sections 199*b* are arranged in the extending direction of the second water-repellent layer 198, is formed at the outer end of the second water-repellent layer 198 separated far from the first water-repellent layer 141. The water-repellent section array 200 is formed at the position extremely near to the boundary line 196 between the second water-repellent layer 198 and the hydrophilic area 128*b* to 128*e*.

Owing to this arrangement, the ink droplet, which is disposed on the boundary line 195 between the second water-repellent layer 198 and the hydrophilic area 128*a* to 128*d*, easily rides over the boundary line 195 as compared with the ink droplet which is disposed on the boundary line 196 between the second water-repellent layer 198 and the hydrophilic area 128*b* to 128*e* and the ink droplet which is disposed on the boundary line 197 between the first water-repellent layer 141 and the hydrophilic area 128*a*. In other words, the upper limit value of the critical angle of each of the ink droplets disposed on the boundary lines 196, 197 is larger than that of the ink droplet disposed on the boundary line 195, because the high water-repellent sections 199*b* are not formed at the end of the second water-repellent layer 198 on the side near to the first water-repellent layer 141. Therefore, the ink droplet, which is disposed on the boundary line 195, easily arrives at the critical angle as compared with those disposed on the other boundary lines 196, 197, and the ink droplet is moved in the direction to make separation from the nozzles 109 on the second water-repellent layer 198. The ink droplet, which is disposed on the boundary line 196, cannot be moved onto the second water-repellent layer 198 due to the high water-repellent sections 199 formed in the vicinity thereof. As described above, the second water-repellent layer 198 according to the third modified embodiment also makes it possible to distance the ink droplets from the nozzles 109 in accordance with the reciprocating movement of the head unit 63 in the same manner as the second water-repellent layer 142 described above.

According to the ink-jet heads 6*a* to 6*d* of the ink-jet printer 1 in the embodiment of the present invention as described above, the ink droplets 161, 162, which are adhered to the ink discharge surface 129, can be distanced from the nozzles 109, for example, by the force of air and the inertial force received by the reciprocating movement of the head unit 63. Therefore, the ink droplets 161, 162, which are adhered to the ink discharge surface 129, are absorbed by the ink-absorbing members 125. Accordingly, it is possible to remove the ink droplets 161, 162 from the ink discharge surface 129. As a result, it is unnecessary to frequently wipe the ink discharge surface 129. Further, it is possible to decrease the frequency of execution of the wiping operation. Therefore, it is possible to obtain a long service life of the ink discharge surface, and it is possible to obtain a high printing speed in the case of the use for a serial printer.

The second water-repellent layers 142 and the hydrophilic areas 128*a* to 128*e* are alternately formed on the ink discharge surface 129. Therefore, the ink droplets 161, 162 can be once retained by the hydrophilic areas 128*b* to 128*d* between the second water-repellent layers 142. Therefore, even when the direction of the reciprocating movement of the head unit 63 is reversed from one direction to make change into the other direction, it is easy for the ink droplets 161, 162 to gradually distance from the nozzles 109. Further, the ink droplets are hardly adhered to the surroundings of the nozzles 109 owing to the fact that the first water-repellent layer 141 is formed on the ink discharge surface 129.

The reciprocating movement velocity and the acceleration of the head unit 63 are adjusted so that the force, which is such an extent that the critical angle is not exceeded, is applied to the ink droplets 161, 162 on the boundary lines 151, 153, and the force, which is such an extent that the critical angle is exceeded at the tip portions at the ends 142*a* of the second water-repellent layers 142, is applied to the ink droplets 161, 162 on the boundary lines 152. Therefore, it is unnecessary for the ink-jet printer 1 to possess any special device or structure which applies the force to forcibly move the ink droplets 161, 162 to the ink-absorbing members 125. Accordingly, the production cost of the ink-jet printer 1 is not increased.

Figure 13A:
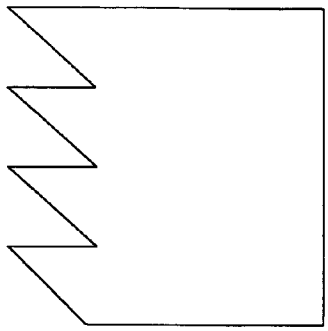
FIGS. 13A to 13D illustrate various modified embodiments of patterns of liquid-repellent areas.
Figure 13B:
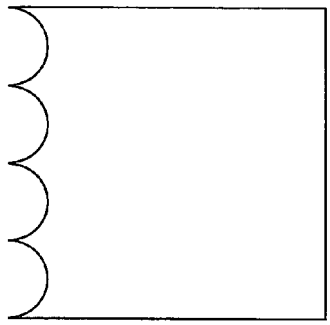
Figure 13C:
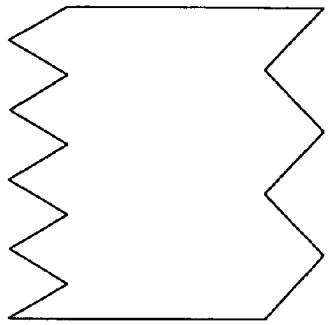
Figure 13D:
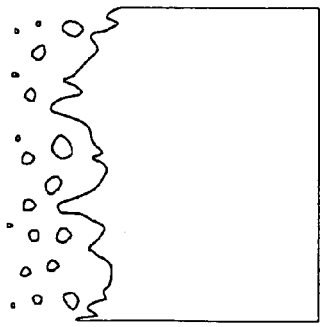

Several patterns of the liquid-repellent area have been shown in FIGS. 5 to 8. However, there is no limitation thereto. It is possible to use various patterns as shown in FIGS. 13A to 13D. FIG. 13A shows an asymmetrical zigzag shape, and FIG. 13B shows a pattern in which curved lines are used. Any one of these patterns is such a pattern that the liquid repellence is lowered on the side disposed near to the nozzles (on the left side as viewed in the drawing). FIG. 13C shows a pattern in which the both sides are nonlinear, but the inclinations of the zigzag shape are smaller on the side disposed near to the nozzles. In FIG. 13D, the liquid-repellent material is distributed in a form of islands on the side disposed near to the nozzles (on the left side as viewed in the drawing), and the distribution density thereof is increased at positions farther from the nozzles.

In the present invention, the magnitude or degree of the liquid repellence can be judged and evaluated, for example, as follows. That is, a liquid droplet is placed on a surface on which a liquid-repellent area is formed, the angle, at which the liquid droplet starts rolling when the surface is gradually inclined, is measured, and thus the magnitude or degree of the liquid repellence of the liquid-repellent area is judged and evaluated. Alternatively, a liquid is pressurized and supplied in a certain direction onto a surface on which a liquid-repellent area is formed, the pressure (critical pressure), at which the liquid starts movement, is judged, and thus the magnitude or degree of the liquid repellence of the liquid-repellent area is judged and evaluated.

Second Embodiment

Figure 9:
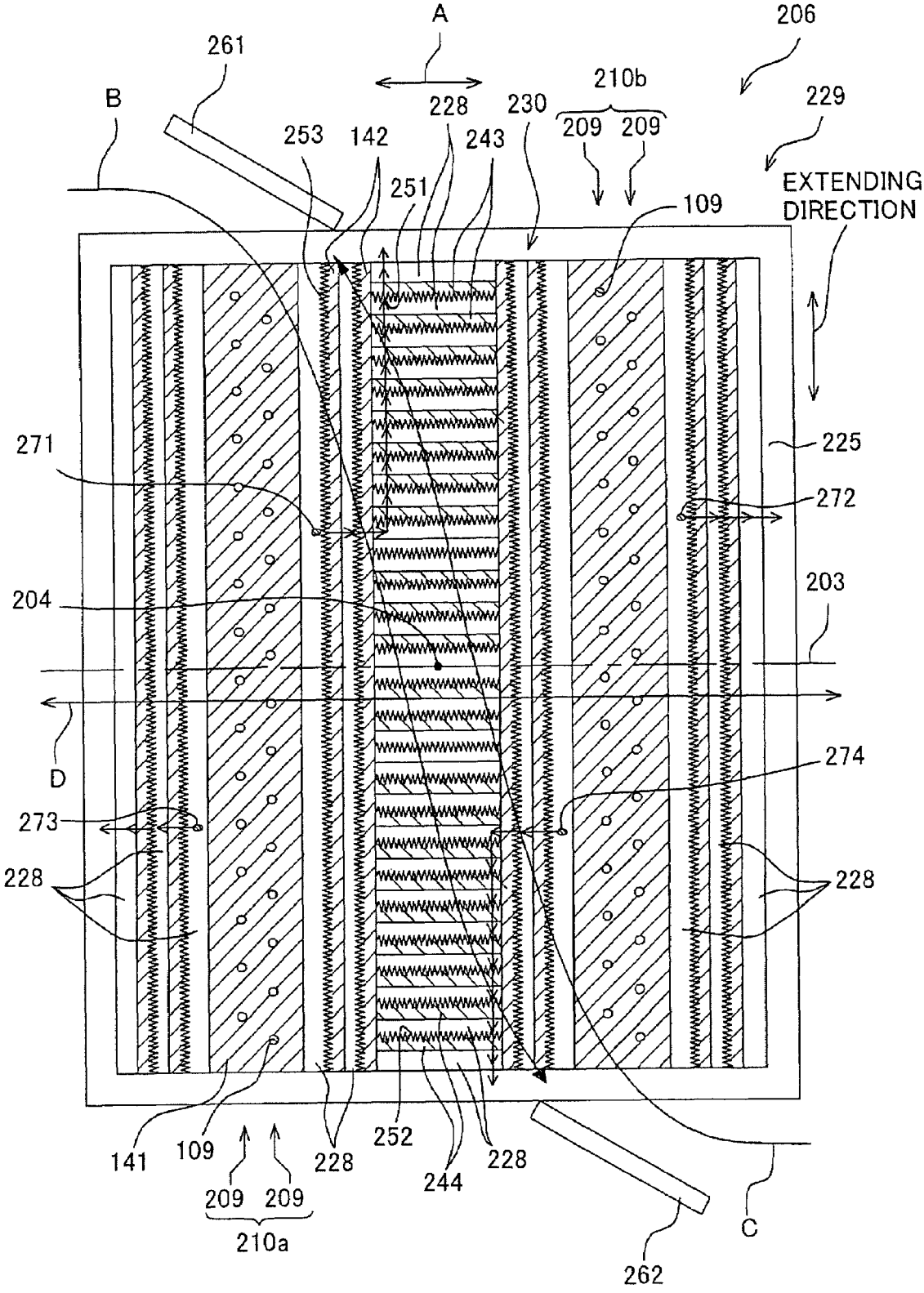
FIG. 9 illustrates an ink discharge surface of an ink-jet head according to a second embodiment of the present invention.

Next, an explanation will be made below with reference to FIG. 9 about an ink-jet head according to a second embodiment. FIG. 9 illustrates an ink discharge surface 229 of the ink-jet head 206 according to the second embodiment of the present invention. The same components or parts as those mentioned in the first embodiment described above are designated by the same reference numerals, any explanation of which will be omitted.

As shown in FIG. 9, the ink-jet head 206 of this embodiment has nozzle arrays 209 in which a plurality of nozzles 109 are arranged in four arrays on an ink discharge surface 229 in the extending direction of the ink discharge surface 229. Two arrays of the four nozzle arrays 209 are arranged in an isolated manner at deviated positions on each of the right and left sides on the ink discharge surface 229 as shown in FIG. 9. Nozzle array groups 210*a*, 210*b* are formed by the respective two nozzle arrays 209 on the respective sides. The plurality of nozzles 109, which belong to each of the nozzles groups 210*a*, 210*b*, are arranged in a zigzag form in the extending direction of the ink discharge surface 229.

Water-repellent layers 230 are formed on the ink discharge surface 229, which include first water-repellent layers 141, second water-repellent layers 142, third water-repellent layers (fifth areas) 243, and fourth water-repellent layers (fifth areas) 244. A plurality of areas in which no water-repellent layer 230 is formed, i.e., hydrophilic areas 228 are formed on the ink discharge surface 229. An ink-absorbing member 225, which is similar to the ink-absorbing member 125 described above, is formed at the outer circumference of the ink discharge surface 229 so that the water-repellent layers 230 are surrounded thereby.

Two of the first water-repellent layers 141 are formed to interpose the third and fourth water-repellent layers 243, 244 therebetween on the left and right sides as shown in FIG. 9. Each of the first water-repellent layers 141 is formed for each of the nozzle groups 210*a*, 210*b* so that the vicinities of the outer circumferences of the plurality of nozzles 109 are covered therewith. The second water-repellent layers 142 are formed in the extending direction of the ink discharge surface 229, and are formed in eight arrays while being isolated from each other in the direction perpendicular to the extending direction of the ink discharge surface 229. Two arrays of the second water-repellent layers 142 are arranged on the left and right sides as shown in FIG. 9 with respect to one first water-repellent layer 141 respectively. Each of the first to fourth water-repellent layers 141, 142, 243, 244 is composed of a fluororesin in the same manner as described above.

The third water-repellent layers 243 and the fourth water-repellent layers 244 are constructed in the same manner as the second water-repellent layers 142, but have a shorter length in the extending direction and are arranged while being rotated by 90° so that the extending direction thereof is parallel to the direction perpendicular to the extending direction of the ink discharge surface 229. A plurality of the third water-repellent layers 243 and a plurality of the fourth water-repellent layers 244 are arranged while being isolated from each other in parallel to the extending direction of the ink discharge surface 229. Accordingly, the hydrophilic areas (fourth areas) 228, which extend in the same direction as that of the third and fourth water-repellent layers 243, 244, are formed between the ink-absorbing member 225 and the third water-repellent layer 243, between the third water-repellent layers 243, between the third and fourth water-repellent layers 243, 244, between the fourth water-repellent layers 244, and the ink-absorbing member 225 and the fourth water-repellent layer 244 on the ink discharge surface 229. The plurality of third water-repellent layers 243 are arranged at upper positions as shown in FIG. 9 with respect to the boundary of the center line 203 which is perpendicular to the extending direction of the ink discharge surface 229. The third water-repellent layers 243 and the hydrophilic areas 228 are arranged alternately in the extending direction of the ink discharge surface 229. The plurality of fourth water-repellent layers 244 are arranged at lower positions as shown in FIG. 9 with respect to the boundary of the center line 203. The fourth water-repellent layers 244 and the hydrophilic areas 228 are arranged alternately in the extending direction of the ink discharge surface 229. Each of the third water-repellent layers 243 is arranged such that the boundary line 251 with the zigzag shape between the third water-repellent layer 243 and the hydrophilic area 228 is directed downwardly as shown in FIG. 9. Each of the fourth water-repellent layers 244 is arranged such that the boundary line 252 with the zigzag shape between the fourth water-repellent layer 244 and the hydrophilic area 228 is directed upwardly as shown in FIG. 9. Each of the second water-repellent layers 142 is arranged such that the boundary line 253 with the zigzag shape between the second water-repellent layer 142 and the hydrophilic area 228 is disposed on the side near to the nozzles 109 in the same manner as described above.

Wind direction plates 261, 262 are provided on the side walls of the ink-jet head 206 corresponding to upper and lower parts as shown in FIG. 9 respectively. The wind direction plates 261, 262 are inclined to make approach to the side walls on which they are provided respectively. Both of the wind direction plates 261, 262 slightly protrude in the direction (direction of the discharge of the ink from the nozzles 109) perpendicular to the paper surface of FIG. 9 from the ink discharge surface 229. Both of the wind direction plates 261, 262 are arranged so that they are in point symmetry in relation to the central point 204 of the ink discharge surface 229. The wind direction plates 261, 262 as described above are operated as follows when the ink-jet head 206 makes the reciprocating movement in the directions of the arrow A shown in FIG. 9 in accordance with the reciprocating movement of the head unit. That is, the wind direction plate 261 creates the air flow B which is directed from the upper portion to the lower portion as shown in FIG. 9 over the ink discharge surface 229, and the wind direction plate 262 creates the air flow C which is directed from the lower portion to the upper portion as shown in FIG. 9 over the ink discharge surface 229. Accordingly, there are the air flows B, C and the air flow D which is directed in the left and right directions as shown in FIG. 9 (directions of the reciprocating movement of the head unit) created by the reciprocating movement of the head unit over the ink discharge surface 229 (actually, there are air flows in which the flows as described above are mixed with each other). The air flow B is created by the wind direction plate 261, which is principally directed from the upper portion in FIG. 9 to the lower portion via the area in which the fourth water-repellent layers 244 are formed. The air flow C is created by the wind direction plate 262, which is principally directed from the lower portion in FIG. 9 to the upper portion via the area in which the third water-repellent layers 243 are formed.

When the printing operation is performed on the printing paper by using the ink-jet head 206 as described above, the ink droplets are also discharged from the nozzles 109 while making the reciprocating movement by the aid of the driving mechanism 65 in the same manner as in the first embodiment. During this process, for example, as shown in FIG. 9, four ink droplets 271 to 274 are adhered onto the hydrophilic areas 228 between the first water-repellent layers 141 and the second water-repellent layers, for example, due to the ink mist and/or the rebound of the ink droplets from the printing paper on the ink discharge surface 229. Of the four adhered ink droplets 271 to 274, the ink droplets 272, 273, which are adhered at the positions outside the first water-repellent layers 141, are moved outwardly by the air flow D created by the reciprocating movement of the ink-jet head 206, and they are absorbed by the ink-absorbing member 225. In relation to this movement, the second water-repellent layers 142, which are formed outside the ink droplets 272, 273, are designed such that the boundary lines 253 of the second water-repellent layers 142 with respect to the hydrophilic areas 228, which are disposed on the sides of the nozzles 109, have the zigzag shapes. Accordingly, the ink droplets 272, 273 easily arrive at the critical angle only when the ink droplets 272, 273 ride over the boundary lines 253. Therefore, in the same manner as described above, the ink droplets 272, 273 are moved to the ink-absorbing member 225 while riding over the second water-repellent layers 142 outwardly from the hydrophilic areas 228 between the first water-repellent layers 141 and the second water-repellent layers 142. Thus., the ink droplets 272, 273 are absorbed by the ink-absorbing member 225.

On the other hand, the ink droplet 271, which is adhered at the position inside as compared with the first water-repellent layer 141 on the ink discharge surface 229, is moved toward the center of the area disposed upwardly from the center line 203 of the ink discharge surface 229 formed with the plurality of third water-repellent layers 243 by the aid of the air flow D created by the reciprocating movement of the ink-jet head 206. The ink droplet 271 is moved upwardly as shown in FIG. 9 from the hydrophilic area 228 between the third water-repellent layers 243 by the aid of the air flow C, and it is absorbed by the ink-absorbing member 225. In relation to this movement, the second water-repellent layers 142, which are formed inside as compared with the first water-repellent layer 141, are designed such that the boundary lines 253 of the second water-repellent layers 142 with respect to the hydrophilic areas 228, which are disposed on the sides of the nozzles 109, have the zigzag shapes, and the boundary lines 251, which are disposed between the hydrophilic areas 228 and the ends on the lower sides of the third water-repellent layers 243 shown in FIG. 9, have the zigzag shapes. Accordingly, the ink droplet 271 easily arrives at the critical angle only when the ink droplet 271 rides over the boundary lines 251, 253. Therefore, the ink droplet 271 is moved inwardly from the hydrophilic area 228 between the first water-repellent layer 141 and the second water-repellent layer 142. The ink droplet 271 rides over the second water-repellent layers 142, and arrives at the hydrophilic area 228 between the third water-repellent layers 243. The ink droplet 271 is moved therefrom to ride over the third water-repellent layers 243, and is moved to the ink-absorbing member 225. Thus, the ink droplet 271 is absorbed by the ink-absorbing member 225.

Further, the ink droplet 274 is moved toward the center of the area disposed downwardly from the center line 203 of the ink discharge surface 229 formed with the plurality of fourth water-repellent layers 244 by the aid of the air flow D created by the reciprocating movement of the ink-jet head 206 in the reciprocating movement direction. The ink droplet 271 is moved downwardly as shown in FIG. 9 from the hydrophilic area 228 between the fourth water-repellent layers 244 by the aid of the air flow B, and is absorbed by the ink-absorbing member 225. Also in relation to this movement, the second water-repellent layers 142, which are formed inside as compared with the first water-repellent layer 141, are designed such that the boundary lines 253 of the second water-repellent layers 142 with respect to the hydrophilic areas 228, which are disposed on the sides of the nozzles 109, have the zigzag shapes, and the boundary lines 252, which are disposed between the hydrophilic areas 228 and the ends on the upper sides of the fourth water-repellent layers 244 shown in FIG. 9, have the zigzag shapes. Accordingly, the ink droplet 274 easily arrives at the critical angle only when the ink droplet 274 rides over the boundary lines 252, 253. Therefore, the ink droplet 274 is moved inwardly from the hydrophilic area 228 between the first water-repellent layer 141 and the second water-repellent layer 142. The ink droplet 274 rides over the second water-repellent layers 142, and it arrives at the hydrophilic area 228 between the fourth water-repellent layers 244. The ink droplet 274 is moved therefrom to ride over the fourth water-repellent layers 244, and is moved to the ink-absorbing member 225. Thus, the ink droplet 274 is absorbed by the ink-absorbing member 225.

Figure 10:
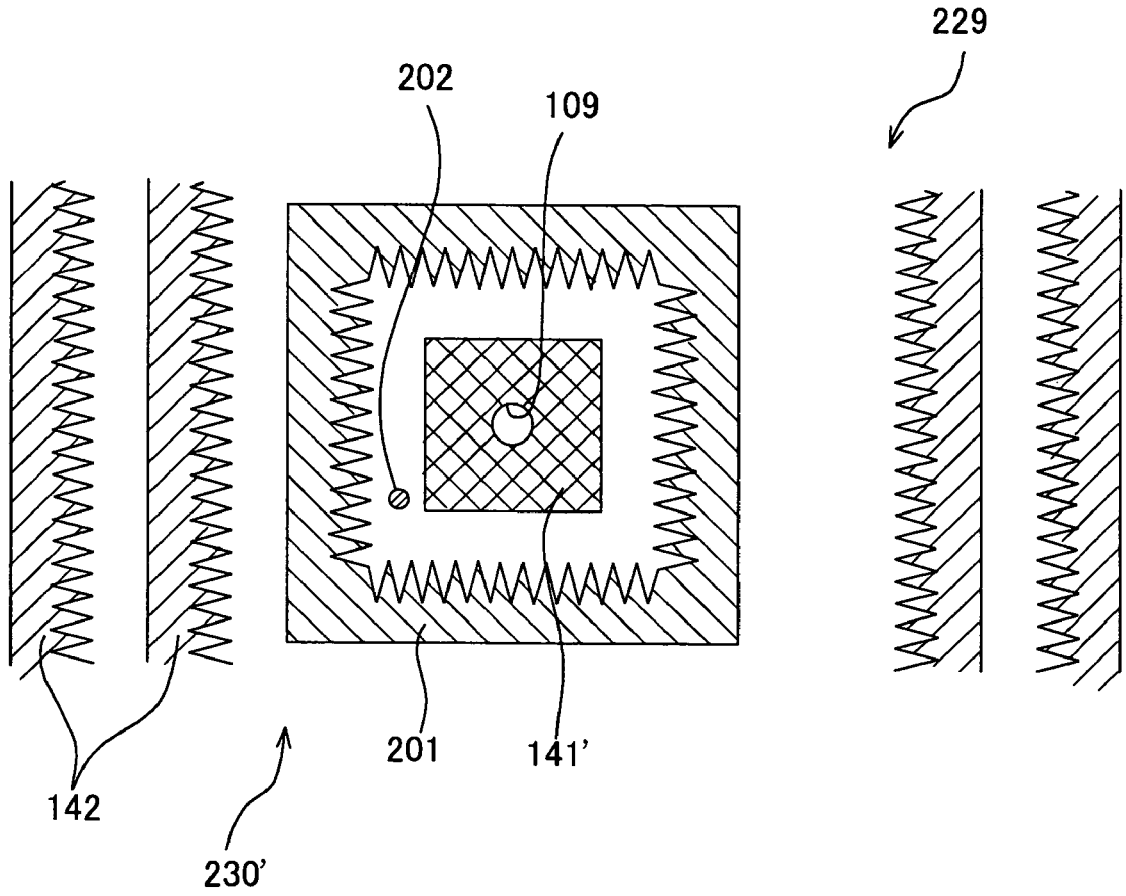
FIG. 10 shows a modified embodiment of a water-repellent layer formed on the ink discharge surface of the ink-jet head according to the second embodiment of the present invention.

The first water-repellent layer 141 of the water-repellent layers 230, which is formed on the ink discharge surface 229 of the ink-jet head 206 of the second embodiment, is formed so that all of the vicinities of the outer circumferences of the nozzles 109 belonging to each of the nozzle groups 210*a*, 210*b* are covered therewith. However, a water-repellent layer 230' as shown in FIG. 10 is also available. FIG. 10 shows a magnified view illustrating a modified embodiment of the water-repellent layer 230 formed on the ink discharge surface 229 of the ink-jet head 206 according to the second embodiment of the present invention. As shown in FIG. 10, the water-repellent layer 230' includes a first water-repellent layer 141' which is formed to cover each of the vicinities of the outer circumferences of the respective nozzles 109, and a surrounding water-repellent layer 201 which is formed by continuously providing the second to fourth water-repellent layers as described above so that the first water-repellent layer 141' is surrounded thereby. When the surrounding water-repellent layer 201 is formed as described above, for example, an ink droplet 202, which is adhered to the hydrophilic area between the first water-repellent layer 141' and the surrounding water-repellent layer 201, can be moved not only in the direction parallel to the direction of the reciprocating movement but also in the vertical direction as viewed in FIG. 10 by the aid of the air flow created when the ink-jet head makes the reciprocating movement. Therefore, the ink droplet 202 can be easily distanced from the nozzle 109.

As described above, according to the ink-jet head 206 of this embodiment, the ink droplets 271 to 274, which are adhered to the ink discharge surface 229, can be also distanced from the nozzles 109, for example, by the force of air and the inertial force received by the reciprocating movement of the ink-jet head 206 in the same manner as in the first embodiment. Therefore, the ink droplets 271 to 274, which are adhered to the ink discharge surface 229, can be absorbed by the ink-absorbing member 225. Accordingly, it is possible to remove the ink droplets 271 to 274 from the ink discharge surface 229. As a result, it is unnecessary to frequently wipe the ink discharge surface 229. Further, it is possible to decrease the frequency of execution of the wiping operation.

Third Embodiment

Figure 11:
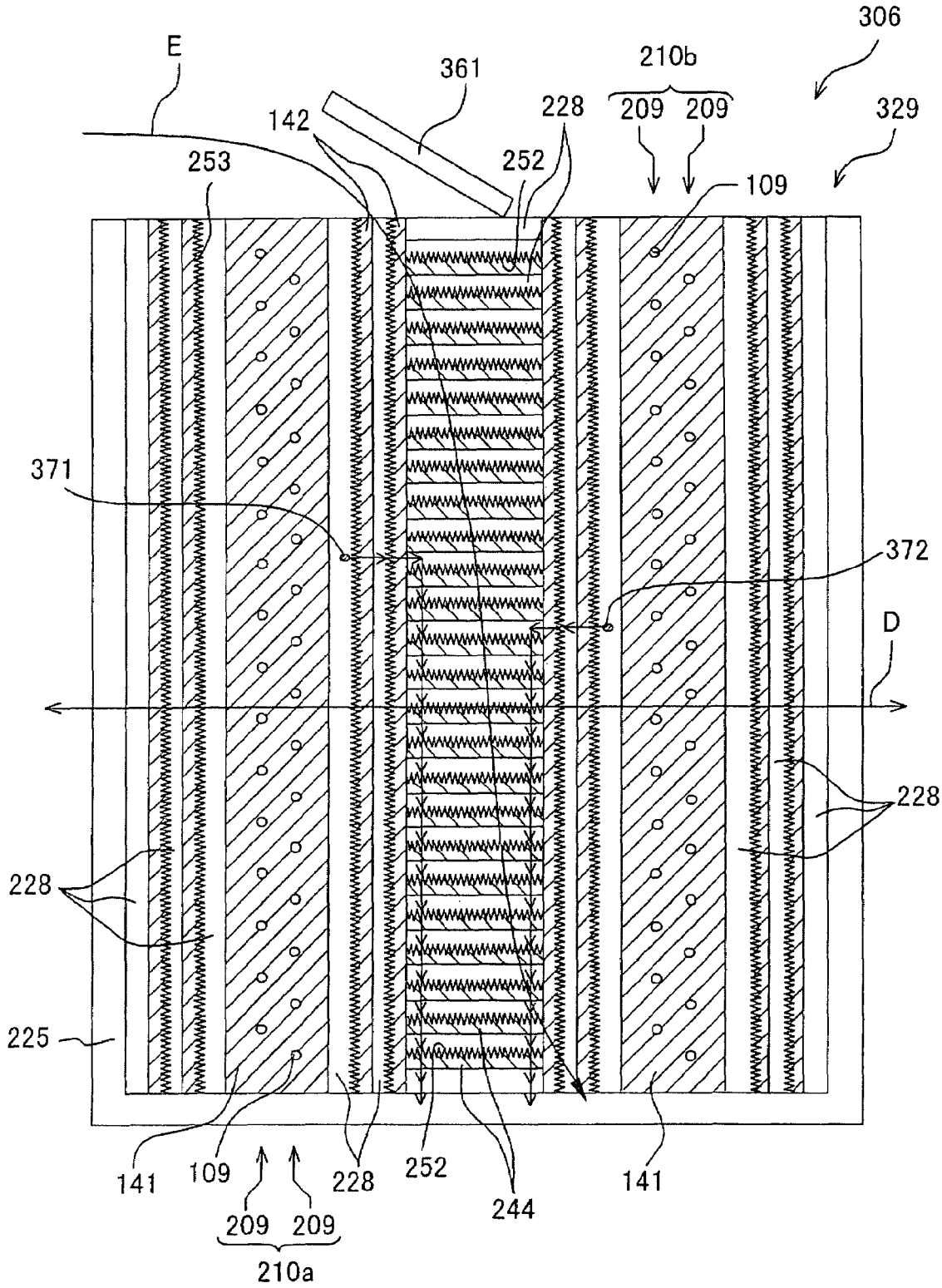
FIG. 11 illustrates an ink discharge surface of an ink-jet head according to a third embodiment of the present invention.

Next, an explanation will be made below with reference to FIG. 11 about an ink-jet head according to a third embodiment. FIG. 11 illustrates an ink discharge surface 329 of the ink-jet head 306 according to the third embodiment of the present invention. The same components or parts as those in the first and second embodiments described above are designated by the same reference numerals, any explanation of which will be omitted.

As shown in FIG. 11, the ink-jet head 306 of this embodiment is constructed in approximately the same manner as the ink-jet head 206 of the second embodiment. However, the third water-repellent layers 243 described above are not formed on the ink discharge surface 329. Alternatively, a plurality of the fourth water-repellent layers 244 are arranged while being isolated from each other in the extending direction of the ink discharge surface 329. Only one wind direction plate 361, which is similar to the wind direction plate 261 described above, is provided at an upper position as shown in FIG. 11. However, the wind direction plate 361 is arranged in the vicinity of the upper central portion with respect to the ink discharge surface 329. The wind direction plate 361 creates the air flow E which is directed from upper positions to lower positions as shown in FIG. 11 over the ink discharge surface 329 in accordance with the reciprocating movement of the head unit. The air flow E, which is created by the wind direction plate 361, principally passes across the area in which the fourth water-repellent layers 244 are formed. An ink-absorbing member 325, which is similar to the ink-absorbing member 125 described above, is formed at the outer circumference of the ink discharge surface 329 except for the upper portion as shown in FIG. 11.

When the printing operation is performed on the printing paper by using the ink-jet head 306 as described above, the ink droplets are also discharged from the nozzles 109 while making the reciprocating movement by the aid of the driving mechanism 65 in the same manner as in the first and second embodiments. During this process, for example, as shown in FIG. 11, two ink droplets 371 to 372 are adhered onto the hydrophilic areas 228 between the first water-repellent layers 141 and the second water-repellent layers, for example, due to the ink mist and/or the rebound of the ink droplets from the printing paper on the ink discharge surface 329. Of the two adhered ink droplets 371 to 372, the ink droplet 371 is moved in the rightward direction as shown in FIG. 11 (direction to make approach to the fourth water-repellent layers 244) on the ink discharge surface 329 in accordance with the air flow D created by the reciprocating movement of the ink-jet head 306. The ink droplet 371 is moved from the hydrophilic area 228 between the fourth water-repellent layers 244 downwardly as viewed in FIG. 11 in accordance with the air flow E, and it is absorbed by the ink-absorbing member 325. On the other hand, the ink droplet 372 is moved in the leftward direction as shown in FIG. 11 (direction to make approach to the fourth water-repellent layers 244) in accordance with the air flow D created by the reciprocating movement of the ink-jet head 306. The ink droplet 372 is moved from the hydrophilic area 228 between the fourth water-repellent layers 244 downwardly as viewed in FIG. 11 in accordance with the air flow E, and it is absorbed by the ink-absorbing member 325. Also in relation to the movement as described above, in the same manner as in the second embodiment, the second water-repellent layers 142, which are formed inside as compared with the first water-repellent layers 141, are designed such that the boundary lines 253 of the second water-repellent layers 142 with respect to the hydrophilic areas 228, which are disposed-on the sides of the nozzles 109, have the zigzag shapes, and the boundary lines 252, which are disposed between the hydrophilic areas 228 and the ends of the fourth water-repellent layers 244 on the upper sides as viewed in FIG. 11, have the zigzag shapes. Accordingly, the ink droplets 371, 372 easily arrive at the critical angle only when the ink droplets 371, 372 ride over the boundary lines 252, 253. Therefore, the ink droplets 371, 372 are moved inwardly from the hydrophilic areas 228 between the first water-repellent layers 141 and the second water-repellent layers 142. The ink droplets 371, 372 ride over the second water-repellent layers 142 to arrive at the hydrophilic areas 228 between the fourth water-repellent layers 244. The ink droplets 371, 372 ride over the fourth water-repellent layers 244 therefrom, and are moved to the ink-absorbing member 325. Thus, the ink droplets 371, 372 are absorbed by the ink-absorbing member 325.

As described above, an effect, which is similar to that obtained in the second embodiment, can be also obtained with the ink-jet head 306 of this embodiment. Further, the number of parts for constructing the wind direction plate 361 and the ink-absorbing member 325 of the ink-jet head 306 of the third embodiment is decreased as compared with the ink-jet head 206 of the second embodiment. Therefore, the arrangement is simplified, and the production cost is decreased as compared-with the ink-jet head 206 of the second embodiment.

Next, an explanation will be made about an exemplary application in which the present invention is applied to a window glass of a vehicle. In this exemplary application, it is intended that liquid droplets such as rainwater adhered to the window glass of the vehicle are moved in a desired direction by utilizing the wind force and the inertial force to be received when the vehicle runs so that the field of vision of a driver is improved. The inertial force includes an inertial force generated by the change of moving direction of the vehicle and an inertial force generated during acceleration or deceleration of the vehicle, as well as an inertial force due to the vibration generated by external and internal factor or factors of the vehicle like engine vibration. For example, a plurality of transparent water-repellent layers are formed in a predetermined direction while being separated from each other by spacing distances on the surface of the window glass. In this case, the transparent water-repellent layer is formed by screen-printing a fluororesin, and the layer has water repellence higher than that of the window glass. Accordingly, water-repellent areas (second areas) composed of the water-repellent layers and hydrophilic areas (first areas) composed of the glass surface between the water-repellent layers are arranged and constructed alternately in the predetermined direction without any gap. The boundary lines between the water-repellent areas and the hydrophilic areas include straight lines which are perpendicular to the predetermined direction and zigzag-shaped lines which extend in the direction perpendicular to the predetermined direction, the straight lines and the zigzag-shaped lines being alternately disposed in the same manner as the boundary lines 152, 153 in the first embodiment. Accordingly, the liquid droplets, which are adhered to the window glass, are easily moved in the predetermined direction, and are hardly moved in the direction opposite to the predetermined direction. Therefore, when the extending direction of the boundary lines is established to be perpendicular to the desired direction, the liquid droplets, which are adhered to the window glass, can be easily moved in the desired direction by utilizing the inertial force and the wind force to be received when the vehicle runs. In view of the easiness to move the liquid droplets more promptly, it is desirable that the extending direction of the boundary lines is perpendicular to the direction of the inertial force and the wind force. As illustrated in the exemplary application explained above, the present invention is not limited to the ink-jet head of the ink-jet printer, which is freely applicable to those in which it is intended to move adhered liquid droplets.

Preferred embodiments of the present invention have been explained above. However, the present invention is not limited to the embodiments described above, which may be changed and designed in other various forms within the scope defined in claims. For example, it is also allowable that the first water-repellent layers 141, 141' are not formed at the outer circumferences of the nozzles 109 of the ink-jet head in the first to third embodiments. Further, it is also allowable that the third and fourth water-repellent layers 243, 244 are not formed in the second embodiment. Furthermore, it is also allowable that the fourth water-repellent layers 244 are not formed in the third embodiment. In other words, any area such as the second water-repellent layer, in which the ink droplets are easily moved in only the direction directed outwardly from the nozzles 109, may be formed in the vicinity of the outer circumferences of the nozzles 109 on the ink discharge surface. Accordingly, it is difficult for the ink droplets adhered to the ink discharge surface to make approach to the nozzles 109. Therefore, it is possible to decrease the frequency of execution of the wiping operation for the ink discharge surface. It is also allowable that only one second water-repellent layer is formed on the ink discharge surface. Alternatively, it is also allowable that the hydrophilic areas and the second water-repellent layers are not arranged alternately in the extending direction of the ink discharge surface. Accordingly, the ink droplets, which have ridden over the second water-repellent layer, hardly approach the nozzles 109. Further, it is also allowable that the ink-jet head is not provided with the ink-absorbing member 125, 225, 235 and/or the wind direction plate 261, 262, 361.

Each of the first and second water-repellent layers is formed of the material having the same water repellence. However, the first and second water-repellent layers may be formed of materials having different water repellences provided that the water repellence of the first water-repellent layer is higher than the water repellence of the second water-repellent layer. The boundary line of the second water-repellent layer 142 with respect to the hydrophilic area, which is disposed on the side of the nozzles 109, has the zigzag shape. However, the boundary line may have a gently curved shape, or the boundary line may have a portion having a zigzag shape formed only at a part thereof. Further, it is also allowable that the inclined sections 143, which form the zigzag shape of the boundary line, are not symmetrical in relation to the extending direction of the ink discharge surface 129.

Fourth Embodiment

Next, an explanation will be made below with reference to FIGS. 14A and 14B about a liquid droplet-ejecting apparatus according to a fourth embodiment. FIG. 14B illustrates a pattern for forming a water-repellent layer (or liquid-repellent layer) which is different from those of the foregoing embodiments. A water-repellent layer, formed on a discharge surface 451 has an inner water-repellent layer 273 and an outer water-repellent layer 275 each of which is annular and coaxially surrounds a nozzle 109. The edge portion on the inner circumference side of the outer water-repellent layer 275, namely a boundary portion 275*b* with a hydrophilic area 128*a* forms a zigzag pattern. The edge portion on the outer circumference side of the outer water-repellent layer 275, namely a boundary portion 275*b* with a hydrophilic area 128*b* forms a circle (smooth curved line). Further, the edge portion on the outer circumference side of the inner water-repellent layer 273, namely a boundary portion 273*a* with the hydrophilic area 128*a* also forms a circle (smooth curved line). The edge portions on the inner and outer circumference sides of the outer water-repellent layer 275 are different from each other in the pattern (liquid repellence). Accordingly, as explained in the foregoing embodiment with reference to FIG. 13, a force (force indicated by an arrow in the drawing) which is required for a liquid droplet 461*a* ejected from the nozzle 109 and adhered onto the hydrophilic area 128*a* to enter the outer water-repellent layer 275 is smaller than a force which is required for a liquid droplet 461*b* adhered onto the hydrophilic area 128*b* to enter the outer water-repellent layer 275. Accordingly, when the discharge surface 451 reciprocates in an in-plane direction, or when the liquid droplet receives an inertial force and/or a wind force from various directions, the liquid droplets 461*a*, 461*b* attempt to move in a direction to make separation from the nozzle 109. Therefore, it is possible to prevent the occurrence of solid matters in the vicinity of the nozzle 109.

In addition, it should be noted that the annular water-repellent layer has the following function. That is, when the liquid droplet 461*a*, which is adhered onto the hydrophilic area 128*a*, receives a force in a direction opposite to the arrow indicated in the drawing, the liquid droplet 461*a* makes contact with the boundary portion 273*a* of the inner water-repellent layer 273. Since the boundary portion 273*a* is circular, the liquid droplet 461*a* moves along the curve of the circle in the direction opposite to the arrow, and makes contact with the boundary portion 275*a* of the outer water-repellent layer 275. Then, the liquid droplet 461*a* is able to enter the outer water-repellent layer 275. Thus, when the force acting on the liquid droplet 461*a* is in only one direction, for example, even when the wind blows to the liquid droplet 461*a* in only one direction, the liquid droplet 461*a* is easily removed from the area surrounding the nozzle 109. By annularly forming the water-repellent layer around the nozzle as in this embodiment, it is possible to remove the liquid droplet so that the liquid droplet always moves away from the nozzle 109 even when the liquid droplet adheres to the portion surrounding the nozzle, regardless the direction of external force, and even when the external force is not an reciprocating force.

Figure 14A:
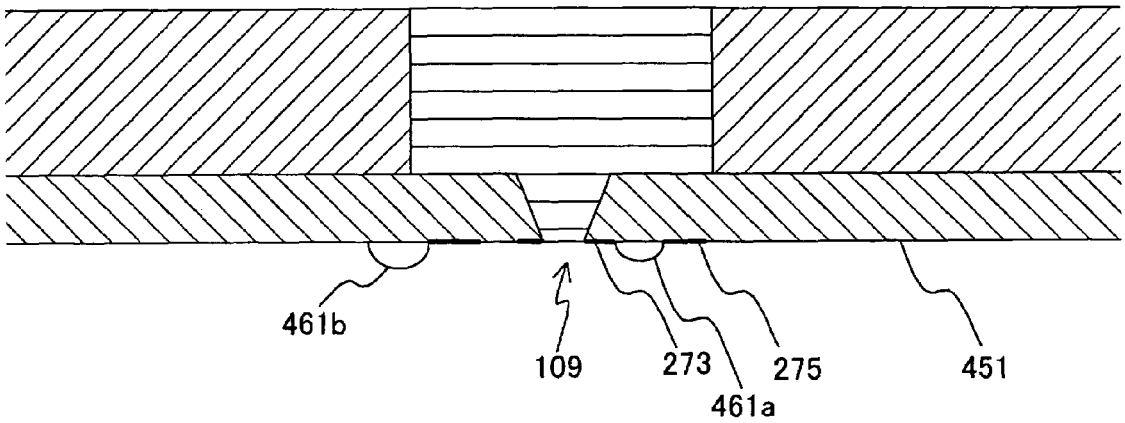
FIG. 14A shows a sectional view depicting a liquid droplet discharge surface of a liquid droplet-discharging apparatus according to a fourth embodiment of the present invention.
Figure 14B:
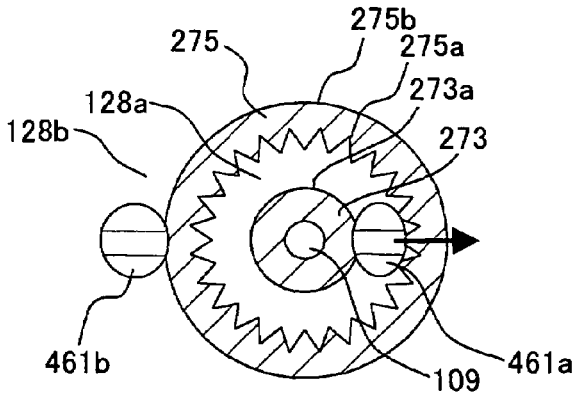
FIG. 14B shows a plan view depicting the liquid droplet discharge surface of the liquid droplet-discharging apparatus according to the fourth embodiment of the present invention.
Figure 15:
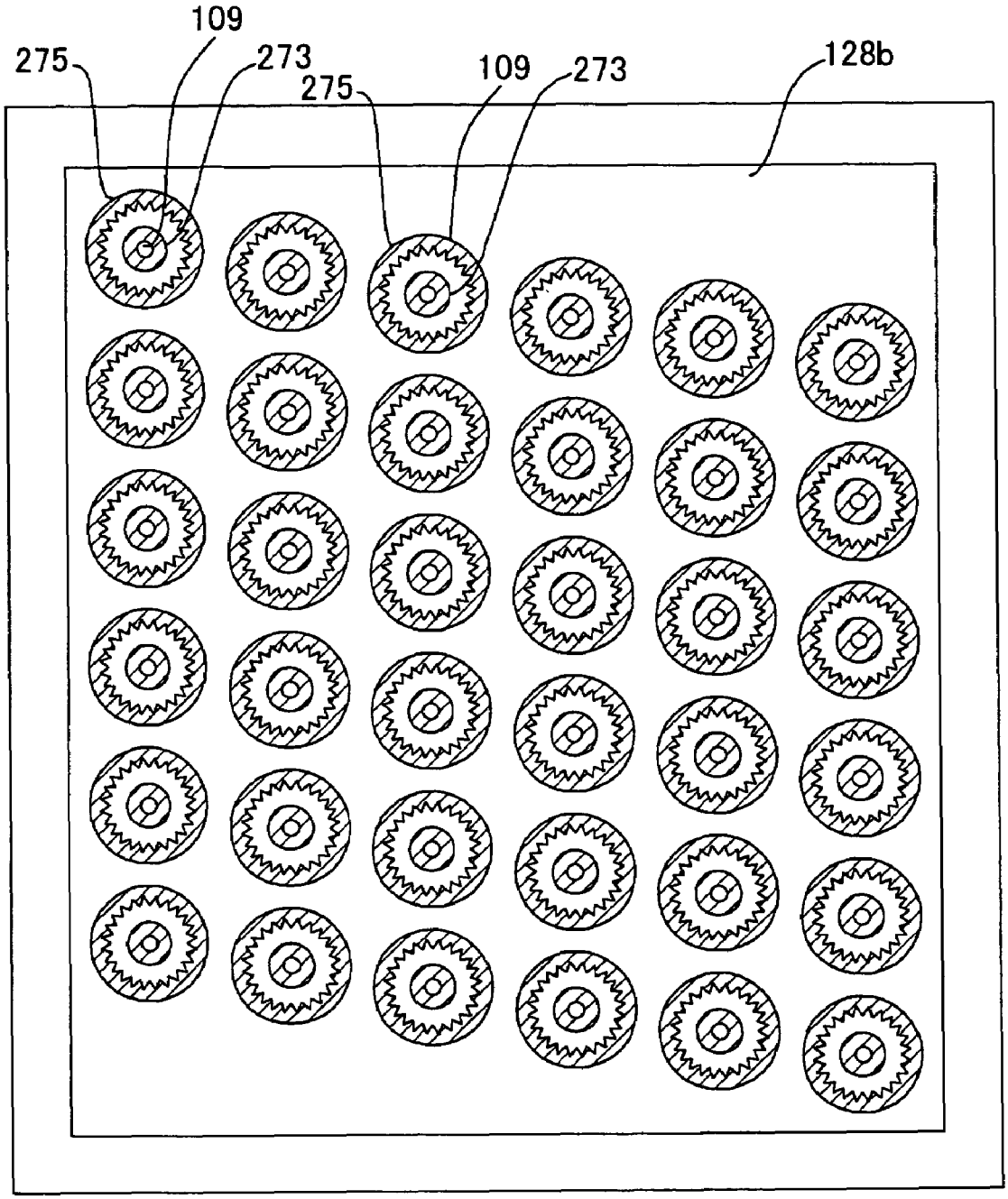
FIG. 15 is a diagram illustrating a state in which a plurality of nozzles are provided in the fourth embodiment of the present invention.

While FIGS. 14A and 14B show the liquid droplet ejecting apparatus in which one nozzle is provided, FIG. 15 shows a case provided with a plurality of nozzles 109 arranged in a matrix, and each of the nozzles 109 may have an annular-shaped inner water-repellent layer 273 and an annular-shaped outer water-repellent layer 275.

Figure 16:
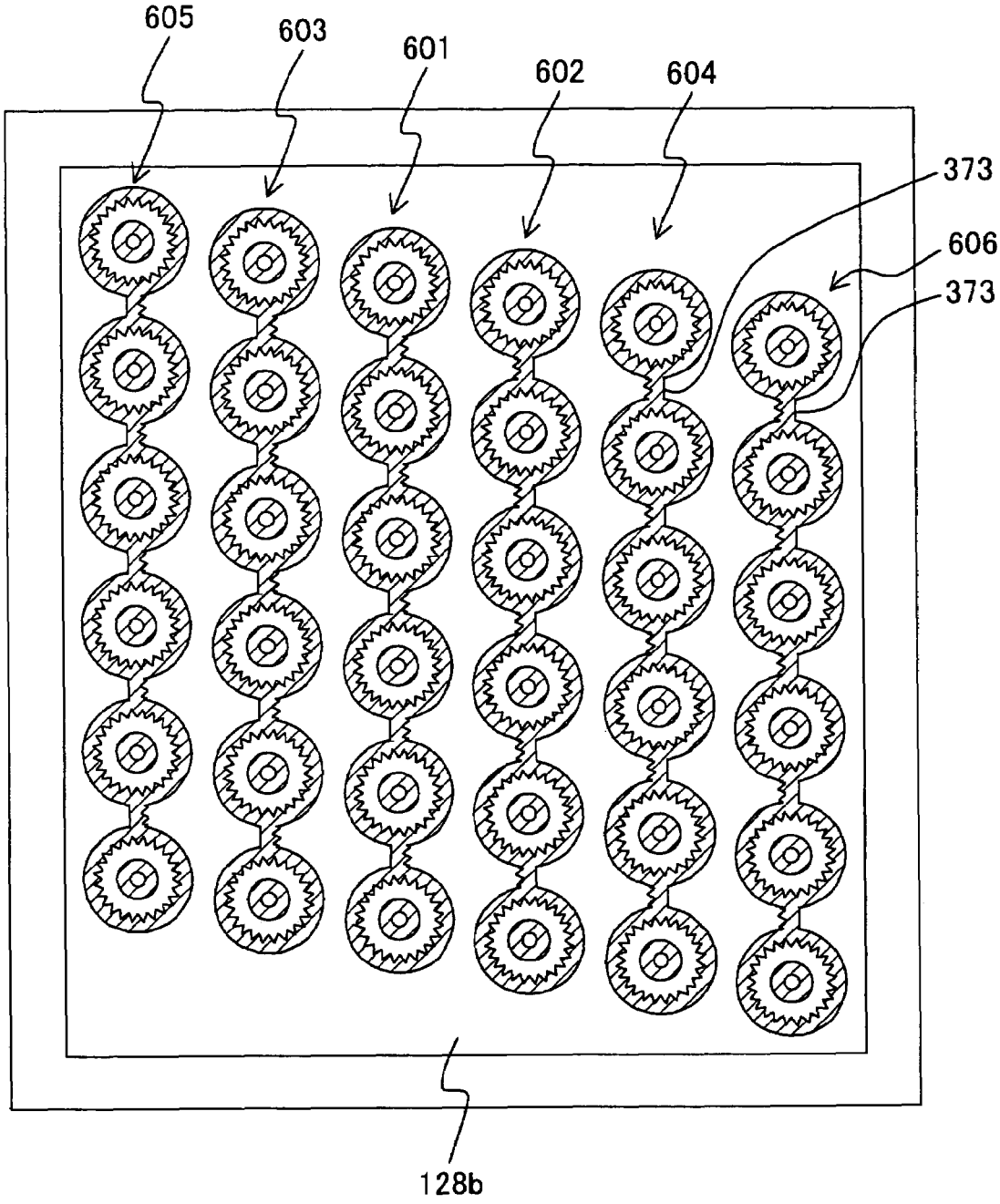
FIG. 16 shows a sectional view depicting a liquid droplet discharge surface of a liquid droplet-discharging, apparatus according to a modified embodiment of the fourth embodiment of the present invention.

FIG. 16 shows a modified embodiment of the pattern of water-repellent layer as shown in FIG. 15. In this modified embodiment, the outer water-repellent layers 275 are connected with one another by aid of connecting portions 373 in columns. A nozzle column 601 and a nozzle column 602 are located in a head center portion in the lateral direction of the drawing. The connecting portions 373 are formed so that one edge portion thereof on the side near to the head center portion has a zigzag pattern, and the other edge portion on the side far from the head center portion has a linear pattern (straight line pattern). Accordingly, a liquid droplet existing in the hydrophilic area 128*b* moves in a direction away from the head center portion by, for example, a wind force, an inertial force and/or a vibration of an actuator which drives the head generated by the movement of a carriage to move the head, each of the forces and vibration having a vector component thereof in a direction perpendicular to the nozzle columns.

Figure 17:
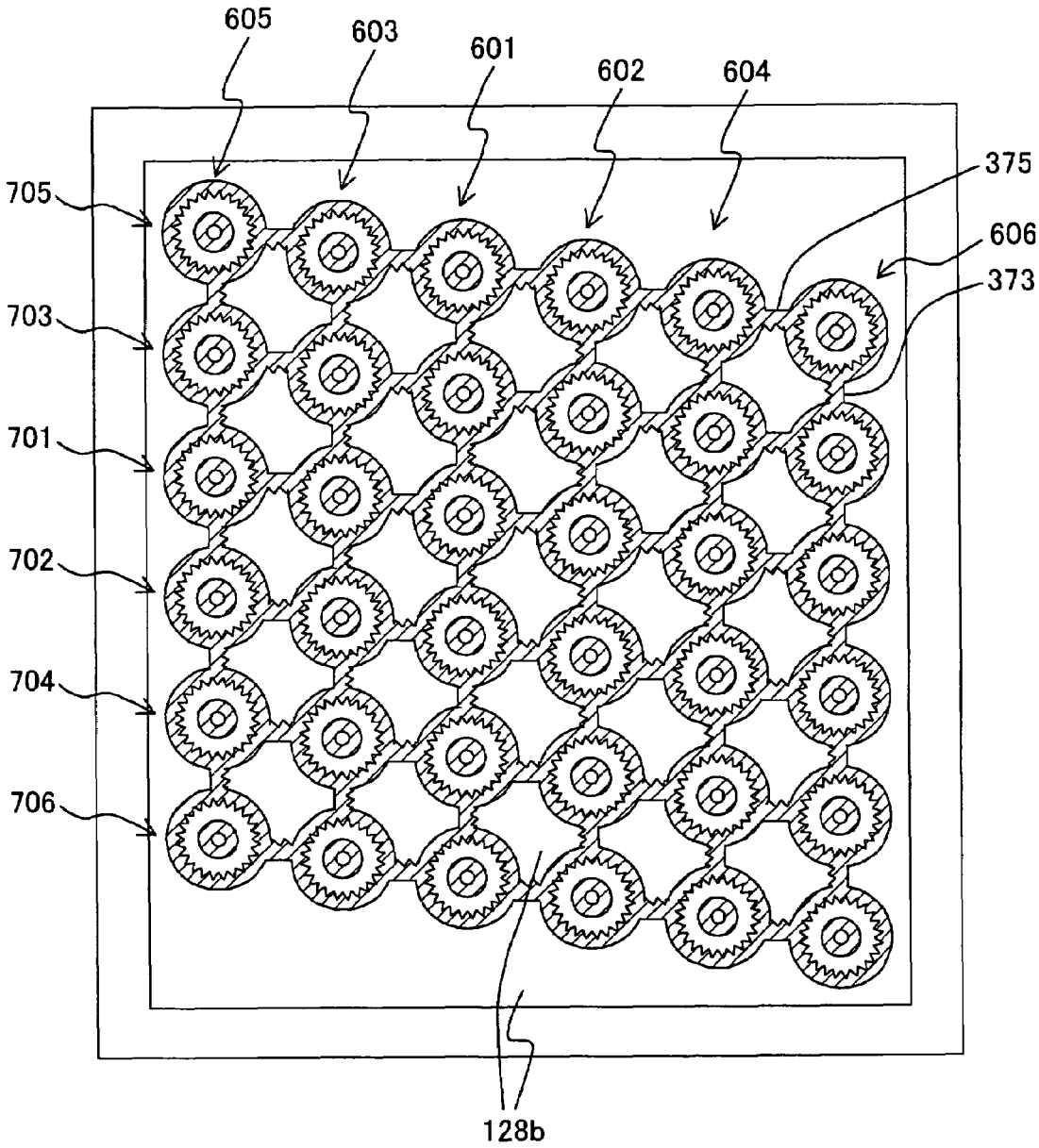
FIG. 17 shows a sectional view depicting a liquid droplet discharge surface of a liquid droplet-discharging apparatus according to a modified embodiment of the fourth embodiment of the present invention.

FIG. 17 shows a modified embodiment of the pattern of water-repellent layer as shown in FIG. 16. In this modified embodiment, the outer water-repellent layers 275 are connected with one another in columns by aid of connecting portions 373 and connected with one another in rows by aid of connecting portions 375. A nozzle column 601 and a nozzle column 602 are located in a head center portion in the lateral direction of the drawing, and a nozzle row 701 and a nozzle row 702 are located in a head center portion in the longitudinal direction of the drawing. The connecting portion 373 is formed so that one edge portion thereof on the side near to the head center portion has a zigzag pattern, and the other edge portion on the side far from the head center portion has a linear pattern. Accordingly, a liquid droplet existing in the hydrophilic area 128*b* moves in a direction to make separation from the head center portion by, for example, a wind force, an inertial force and/or a vibration of an actuator which drives the head generated by the movement of a carriage to move the head, each of the forces and vibration having a vector component thereof in a direction perpendicular to or parallel to the nozzle columns. In addition to, or other than, the pattern for connecting the nozzles as shown in FIG. 17, these nozzles may be connected with one another in an oblique direction by additional or another connecting members.

In the embodiments shown in FIGS. 14A and B to 17, the water-repellent layer and the connecting member are formed to have the zigzag pattern respectively so that the water repellence thereof is lower than that of the straight line pattern or curved line pattern. However, the water repellent layer and the connecting member may be formed with the patterns as shown in FIGS. 6 to 8 in place of the zigzag pattern.

The liquid droplet-ejecting apparatus according to the fourth embodiment may be used as an ink-jet head of an ink-jet apparatus. Alternatively, the liquid droplet-ejecting apparatus may be used as a liquid droplet-ejecting apparatus for ejecting a conductive liquid to form a conductive pattern or as a liquid droplet-ejecting apparatus for ejecting a DNA solution and/or a reagent to perform analyze. However, the liquid droplet-ejecting apparatus is not limited for these applications, and may be used for any liquid-ejecting applications. Accordingly, the liquid droplet is not limited to an ink and/or water, and various kinds of liquid may be used.

What is claimed is:

1. A liquid droplet-ejecting apparatus comprising:

a liquid droplet discharge surface;

a nozzle array which is formed on the liquid droplet discharge surface and which includes a plurality of nozzles for discharging a liquid;

a plurality of first areas which are formed on the liquid droplet discharge surface; and a second area which is formed on the liquid droplet discharge surface, which is positioned adjacently to the first areas between adjoining two first areas, and which has liquid repellence higher than that of the first areas, wherein:

a liquid droplet, which exists in one of the two first areas adjacent to the second area on a side near to the nozzle array, requires a first force to enter the second area, and a liquid droplet, which exists in the other of the two first areas adjacent to the second area on a side far from the nozzle array, requires a second force to enter the second area, the first force being smaller than the second force.

2. The liquid droplet-ejecting apparatus according to claim 1, wherein the first areas and the second area extend in an extending direction of the nozzle array.

3. The liquid droplet-ejecting apparatus according to claim 2, wherein the plurality of first areas and the second area are formed on both sides of the nozzle array, respectively.

4. The liquid droplet-ejecting apparatus according to claim 3, wherein:

the second area has a plurality of sections; and the plurality of first areas and the plurality of sections are alternately formed while adjoining to one another.

5. The liquid droplet-ejecting apparatus according to claim 1, wherein the nozzles of the nozzle array are formed in a third area which has a same liquid repellence as that of the second area, and the third area is positioned adjacently to the first areas between the adjoining two first areas.

6. The liquid droplet-ejecting apparatus according to claim 5, wherein:

a boundary line, which is disposed between a first area and the third area adjacent to the first area on a side near to the nozzle array, is a straight line which is parallel to an extending direction of the nozzle array; and a boundary line, which is disposed between the first area and the second area adjacent to the first area on a side far from the nozzle array, is a line which includes portions having different angles of inclination.

7. The liquid droplet-ejecting apparatus according to claim 6, wherein the boundary line, which is disposed between the first area and the second area adjacent to the first area on the side far from the nozzle array, is a line which includes two types of line segments continued alternately and inclined symmetrically with respect to the extending direction of the nozzle array.

8. The liquid droplet-ejecting apparatus according to claim 5, wherein:

the nozzle array includes a plurality of arrays;

fourth areas and fifth areas which are adjacent to the fourth areas and which have liquid repellence higher than that of the fourth areas are formed between two of the third areas formed for the nozzles which constitute adjoining two arrays, both of the fourth areas and the fifth areas being formed alternately in an extending direction of the nozzle array while extending in a direction perpendicular to the extending direction of the nozzle array; and each of the all fifth areas formed between two of the third areas is established such that a liquid droplet, which exists in a fourth area of the fourth areas adjacent to a fifth area of the fifth areas on one side in the extending direction of the nozzle array, requires a force to enter the fifth area, and a liquid droplet, which exists in a fourth area adjacent to a fifth area on the other side in the extending direction of the nozzle array, requires a force to enter the fifth area, the former force being smaller than the latter force.

9. The liquid droplet-ejecting apparatus according to claim 8, further comprising liquid-absorbing members which are arranged outside the second area formed at an outermost position and outside the fifth area formed at an outermost position respectively.

10. The liquid droplet-ejecting apparatus according to claim 5, wherein:

the nozzle array includes a plurality of arrays;

fourth areas and fifth areas which are adjacent to the fourth areas and which have liquid repellence higher than that of the fourth areas are formed between two of the third areas formed for the nozzles which constitute adjoining two arrays, both of the fourth areas and the fifth areas being formed alternately in an extending direction of the nozzle array while extending in a direction perpendicular to the extending direction of the nozzle array;

a first group of mutually adjoining fifth areas of the fifth areas, which includes one of two fifth areas formed on outermost sides in the extending direction of the nozzle array, of the all fifth areas formed between two of the third areas, is established such that a liquid droplet, which exists in a fourth area of the fourth areas adjacent inwardly to a fifth area in the extending direction of the nozzle array, requires a force to enter the fifth area, and a liquid droplet, which exists in a fourth area adjacent outwardly to a fifth area in the extending direction of the nozzle array, requires a force to enter the fifth area, the former force being smaller than the latter force; and a second group of mutually adjoining fifth areas, which includes the other of the two fifth areas formed on the outermost sides in the extending direction of the nozzle array, is established such that a liquid droplet, which exists in a fourth area adjacent inwardly to a fifth area in the extending direction of the nozzle array, requires a force to enter the fifth area, and a liquid droplet, which exists in a fourth area adjacent outwardly to a fifth area in the extending direction of the nozzle array, requires a force to enter the fifth area, the former force being smaller than the latter force.

11. The liquid droplet-ejecting apparatus according to claim 5, wherein:

a boundary line, which is disposed between a first area of the first areas and the third area adjacent to the first area on a side near to the nozzle array, is a first zigzag line which extends in an extending direction of the nozzle array; and a boundary line, which is disposed between the first area and the second area adjacent to the first area on a side far from the nozzle array, is a second zigzag line which has an inclination smaller than an inclination of the first zigzag line.

12. The liquid droplet-ejecting apparatus according to claim 1, wherein the first and second areas extend to surround the nozzle.

13. The liquid droplet-ejecting apparatus according to claim 1, wherein a plurality of zones, which have liquid repellence higher than that of the first areas, are provided in the second area so that the liquid repellence is increased in a stepwise manner as a zone position is farther from the nozzle array in a direction perpendicular to an extending direction of the nozzle array.

14. The liquid droplet-ejecting apparatus according to claim 1, wherein a large number of portions, which have liquid repellence lower than that of the second area, are formed in the second area, and the portions, which have the lower liquid repellence in the second area, have an average density which is gradually decreased in a direction which makes separation from the nozzle array and which is perpendicular to an extending direction of the nozzle array.

15. The liquid droplet-ejecting apparatus according to claim 1, wherein a plurality of portions, which have liquid repellence higher than that of the second area, are formed in the second area, and the portions, which have the higher liquid repellence in the second area, have an average density which is gradually increased in a direction which makes separation from the nozzle array and which is perpendicular to an extending direction of the nozzle array.

16. The liquid droplet-ejecting apparatus according to claim 1, further comprising a liquid-absorbing member which is arranged at a position which is farther from the nozzle array than that of the second area formed farthest from the nozzle array.

17. An ink-jet printer comprising:

an ink-jet head which has a nozzle array including a plurality of nozzles for discharging an ink, the nozzle array being formed on an ink discharge surface;

a medium transport unit which transports a medium on which the ink discharged from the plurality of nozzles lands; and a reciprocating movement unit which reciprocates the ink-jet head in a direction perpendicular to an extending direction of the nozzle array, wherein:

the ink discharge surface of the ink-jet head is formed with two first areas which extend in the extending direction of the nozzle array, and a second area which has liquid repellence higher than that of the first areas and which extends in the extending direction of the nozzle array while being adjacent to the two first areas between the two first areas; and an ink droplet, which exists in one of the two first areas adjacent to the second area in a direction to make approach to the nozzle array, requires a first force to enter the second area, and an ink droplet, which exists in the other of the two first areas adjacent to the second area in a direction to make separation from the nozzle array, requires a second force to enter the second area, the first force being smaller than the second force.

18. The ink-jet printer according to claim 17, wherein the reciprocating movement unit moves the ink-jet head at a velocity to apply, to the ink droplets, a wind force which is larger than the first force and which is smaller than the second force.

19. A liquid droplet-moving apparatus for moving liquid droplets adhered to a liquid droplet-adhering surface by utilizing a wind force or an inertial force, comprising:

first areas and a second area which has liquid repellence higher than that of the first areas, the first and second areas being alternately formed adjacently without any gap in a predetermined direction on the liquid droplet-adhering surface, wherein:

a liquid droplet, which exists in one of the first areas adjacent to the second area on a side directed in the predetermined direction, requires a first force to enter the second area, and a liquid droplet, which exists in other of the first areas adjacent to the second area on a side directed oppositely to the predetermined direction, requires a second force to enter the second area, the first force being smaller than the second force.

20. A liquid droplet-ejecting apparatus comprising:

a liquid droplet discharge surface;

a nozzle which is formed on the liquid droplet discharge surface and which discharges a liquid;

a first area which is formed on the liquid droplet discharge surface; and a second area which is formed in the first area formed on the liquid droplet discharge surface, and which has liquid repellence higher than that of the first area, wherein a liquid droplet, which exists in the first area at a position nearer to the nozzle than the second area, requires a first force to enter the second area, and a liquid droplet, which exists in the first area at a position farther from the nozzle than the second area, requires a second force to enter the second area, the first force being smaller than the second force.

21. The liquid droplet-ejecting apparatus according to claim 20, wherein the second area has an annular shape and surrounds the nozzle.

22. The liquid droplet-ejecting apparatus according to claim 21, wherein the first area has an annular shape and surrounds the nozzle.

23. The liquid droplet-ejecting apparatus according to claim 20, wherein a third area which has a same liquid repellence as that of the second area exists on a side nearer to the nozzle than the second area, and the first area exists between the second area and the third area.

24. The liquid droplet-ejecting apparatus according to claim 23, wherein a boundary, which is disposed between the first area and the third area, is defined by a straight line or a smooth curved line.

25. The liquid droplet-ejecting apparatus according to claim 23, wherein a boundary, which is disposed between the second area and the first area existing between the second area and the third area, is defined by a zigzag line; and a boundary, which is disposed between the second area and the first area on a side opposite to the boundary defined by the zigzag line, is defined by a straight line or a smooth curved line.

26. The liquid droplet-ejecting apparatus according to claim 23, wherein a plurality of zones, which have liquid repellence higher than that of the first area, are provided in a boundary which is disposed between the second area and the first area existing between the second area and the third area so that the liquid repellence is increased in a stepwise manner as a zone position is farther from the nozzle.

27. The liquid droplet-ejecting apparatus according to claim 23, wherein a large number of portions, which have liquid repellence lower than that of the second area, are formed in a boundary which is disposed between the second area and the first area existing between the second area and the third area, and the portions having lower liquid repellence in the boundary have an average density which is gradually decreased in a direction which makes separation from the nozzle.

28. The liquid droplet-ejecting apparatus according to claim 23, wherein a large number of portions, which have liquid repellence higher than that of the second area, are formed in a boundary which is disposed between the second area and the first area existing between the second area and the third area, and the portions having higher liquid repellence in the boundary have an average density which is gradually increased in a direction-which makes separation from the nozzle.

29. The liquid droplet-ejecting apparatus according to claim 23, further comprising a liquid-absorbing member which is arranged in the liquid droplet discharge surface at a position which is farther from the nozzle than the first, second and third areas.

30. The liquid droplet-ejecting apparatus according to claim 20, wherein the nozzle includes a plurality of nozzle holes, the second area includes annular areas which are formed in surroundings of the nozzle holes respectively, and the annular areas are connected to one another by liquid-repellent connecting portions.

31. The liquid droplet-ejecting apparatus according to claim 30, each of the connecting portions has a zigzag pattern formed on a predetermined side thereof.

* * * * *